US012644611B2

(12) United States Patent
Lee et al.

(10) Patent No.: US 12,644,611 B2
(45) Date of Patent: Jun. 2, 2026

(54) INDOOR UNIT OF AIR CONDITIONER

(71) Applicant: LG ELECTRONICS INC., Seoul (KR)

(72) Inventors: Miyoung Lee, Seoul (KR); Kidong Kim, Seoul (KR); Siyoung Oh, Seoul (KR); Jaehyeon Kim, Seoul (KR); Seokho Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 595 days.

(21) Appl. No.: 18/019,340

(22) PCT Filed: Aug. 3, 2021

(86) PCT No.: PCT/KR2021/010143
§ 371 (c)(1),
(2) Date: Feb. 2, 2023

(87) PCT Pub. No.: WO2022/030947
PCT Pub. Date: Feb. 10, 2022

(65) Prior Publication Data

US 2023/0280047 A1 Sep. 7, 2023

(30) Foreign Application Priority Data

Aug. 7, 2020 (KR) ..... 10-2020-0099269

(51) Int. Cl.
*F24F 1/0011* (2019.01)
*F24F 3/14* (2006.01)
*F24F 13/14* (2006.01)

(52) U.S. Cl.
CPC ..... *F24F 1/0011* (2013.01); *F24F 13/1426* (2013.01); *F24F 2013/1433* (2013.01)

(58) Field of Classification Search
CPC ..... F24F 1/0011; F24F 13/14; F24F 13/1426; F24F 2013/1433; F24F 2013/1473; F24F 2221/17
See application file for complete search history.

(56) References Cited

U.S. PATENT DOCUMENTS

2010/0307717 A1* 12/2010 Yamashita ..... F24F 13/22 165/96

FOREIGN PATENT DOCUMENTS

| | | |
|---|---|---|
| EP | 3 361 165 | 8/2018 |
| EP | 3 680 572 | 7/2020 |
| KR | 10-2004-0106057 | 12/2004 |
| KR | 10-1043987 | 6/2011 |

(Continued)

OTHER PUBLICATIONS

International Search Report (with English Translation) issued in Application No. PCT/KR2021/010143 dated Dec. 7, 2021.

(Continued)

*Primary Examiner* — Steven S Anderson, II
(74) *Attorney, Agent, or Firm* — KED & ASSOCIATES

(57) ABSTRACT

Provided is an indoor unit of an air conditioner, and the indoor unit includes: a case installed indoors and having an outlet formed in a front or bottom thereof; and a vane module disposed at the case and guiding a flow direction of air discharged from the outlet, and the vane module includes: a first vane disposed in the outlet and rotatably installed on a forward side of a discharge direction of discharged air; a second vane disposed in the outlet and rotatably installed; two motor coupling parts disposed at both ends of the first vane and the second vane, respectively, wherein two motors each have at least a portion of which is exposed to the outlet; a vane motor assembled with at least one of the two motor coupling parts and providing a driving force; a drive link assembled to be rotatable rotatably to the motor coupling part, rotated by the driving force of the vane motor, and transmitting the driving force to the first vane and (Continued)

the second vane; a first vane link assembled to be relatively rotatable with the drive link and the motor coupling part on a forward side of the drive link to thereby rotate the first vane; and a second vane link assembled to be relatively rotatable with the drive link and the motor coupling part on a forward side of the drive link to thereby rotate the second vane, and the first vane link and the second vane link are assembled in a line with the drive link on a forward side of the drive link. Accordingly, a size of the vane itself may be maximized by minimizing a space occupied by a drive module.

17 Claims, 27 Drawing Sheets

(56) References Cited

FOREIGN PATENT DOCUMENTS

| | | | | | |
|---|---|---|---|---|---|
| KR | 10-2014-0101284 | | | 8/2014 | |
| KR | 10-1864027 | | | 6/2018 | |
| KR | 10-2018-0092809 | | | 8/2018 | |
| KR | 20180092809 | A | * | 8/2018 | ..... F24F 1/0011 |
| KR | 10-2019-0033030 | | | 3/2019 | |
| KR | 20190033030 | A | * | 3/2019 | ..... F24F 13/14 |
| KR | 10-2020-0023147 | | | 3/2020 | |
| KR | 10-2020-0023151 | | | 3/2020 | |
| WO | WO 2019-210513 | | | 11/2019 | |

OTHER PUBLICATIONS

German Office Action issued in Application No. 112021004259.9 dated May 9, 2025.

* cited by examiner

INDOOR UNIT OF AIR CONDITIONER

CROSS-REFERENCE TO RELATED PATENT APPLICATIONS

This application is a U.S. National Stage Application under 35 U.S.C. § 371 of PCT Application No. PCT/KR2021/010143, filed Aug. 3, 2021, which claims priority to Korean Patent Application No. 10-2020-0099269, filed Aug. 7, 2020, whose entire disclosures are hereby incorporated by reference.

TECHNICAL FIELD

The present disclosure relates to an indoor unit of an air conditioner, and more particularly, to a wall-mounted indoor unit installed on a wall of an indoor space.

BACKGROUND ART

In general, an air conditioner consists of a compressor, a condenser, an evaporator, and an expander, and supplies cold air or warm air into a building or a room using an air conditioning cycle.

The structure of the air conditioner is classified as a separated type in which a compressor is disposed outside, or as an integrated type in which a compressor is integrated.

In a separated-type air conditioner, an indoor heat exchanger is installed in an indoor unit, whereas an outdoor heat exchanger and a compressor are installed in an outdoor unit to be connected via a refrigerant pipe.

In the integrated-type air conditioner, an indoor heat exchanger, an outdoor heat exchanger, and a compressor are installed in the same case. The integrated-type air conditioner is classified as a window-mounted air conditioner mounted in a device hung over a window or as a duct-mounted air conditioner mounted outside by connecting an intake duct and a discharge duct.

The separated-type air conditioner is classified as a stand-alone air conditioner or as a wall-mounted air conditioner mounted in a wall.

An air-conditioner whose indoor unit is installed vertically in an indoor space is called a stand-type air-conditioner, an air-conditioner whose indoor unit is installed on a wall in a room is called a wall-mounted air-conditioner, and an air-conditioner whose indoor unit installed on a ceiling in a room is called a ceiling-type indoor unit.

Also, as a separation type air conditioner, there is a system air conditioner capable of providing air-conditioned air to a plurality of spaces.

The system air conditioner includes a type in which a plurality of indoor units are provided to air-condition a room, and a type in which air-conditioned air is supplied to each space through a duct.

The plurality of indoor units provided in the system air conditioner may be any of a stand type, a wall-mounted type, or a ceiling type.

The wall-mounted air conditioner includes a case that is installed to be hung on a wall, and an inlet through which air is intaken and an outlet through which air is discharged are disposed in the case, and a discharge vane is installed at the outlet. The wall-mounted air conditioner is disposed on one side wall, and blows air by discharging air to the other side. The wall-mounted air conditioner includes a vane, and changes an air discharge direction variously by moving the vane.

According to the prior art, the vane is disposed at the outlet of the wall-mounted air conditioner. The outlet is formed to be elongated in one direction, and the vane is formed to be elongated in one direction to suit the outlet. A rotational shaft is disposed at both ends of the vane in a longitudinal direction, and the vane rotates along the rotational shaft.

According to a related art, the vane guides the air discharged when energized, and shields the outlet when de-energized. The vanes are formed in a plate shape and, in a non-conduction state, disposed in a vertical direction of the outlet to fully cover the outlet. Accordingly, the vanes prevents dust or foreign substances from entering the outlet in the non-conduction state.

In particular, according to a related art Japanese Laid-Open Patent Application Publication No. 2014-244152A, there has been disclosed that an air wing serving as a discharge vane is formed at one outlet and a louver installed to be rotatable in an area opened by the air wing is formed to form a double vane structure.

As such, when a plurality of vanes are formed in one outlet, there is an advantage in that a flow rate and a wind direction can be finely adjusted to meet a user's need, but as in the prior art, a motor is separately required for driving each vane because each vane is independently formed, and a physical space is required because each driver for connecting the motor and an operation of a vane must be separately provided, and thus, the size of the vane is reduced for this purpose. In addition, when a physical component other than a vane is disposed in a discharge flow path, noise occurs.

Furthermore, when a physical component protruding toward an air path is disposed in the discharge flow path, a flow force of air is reduced as discharged air comes into contact with the physical component, and dew may be condensed in a corresponding area. Such dew condensation may cause permanent damage to the equipment.

RELATED ART DOCUMENT

Patent Document

Japanese Laid-Open Patent Application Publication NO. 2014-244152A (published on Dec. 2, 2014)

DISCLOSURE OF INVENTION

Technical Problem

A first object of the present disclosure is to provide an indoor unit of an air conditioner, which includes an outlet module having a dual vane structure to provide various modes of wind through a first vane and a second vane.

At this point, in the related art, since drive modules are provided for the first vane and the second vane, respectively, there is a loss in space and cost.

Accordingly, a second object of the present disclosure is to provide an indoor unit of an air conditioner, which is capable of controlling a first vane and a second vane through one drive motor.

Meanwhile, in the related art, since the drive modules are provided for the vanes, respectively, the space of the vanes is reduced, which may obstruct a passage of air.

Accordingly, a third object of the present disclosure is to provide a drive module capable of minimizing the size of the drive module while controlling the first vane and the second vane with one drive motor.

In addition, in the related art, since the drive modules of the respective vanes are present in the air passage, unpleasant noise and vibration may occur when the air is discharged to a user. Furthermore, when the drive module protruding toward the air passage is disposed, the discharged air comes into contact with the drive module, thereby reducing a flow force of the air and causing dew condensation in a corresponding area.

Accordingly, a fourth object of the present disclosure is to provide a module capable of minimizing noise, vibration and dew condensation of a drive module capable of simultaneously driving a plurality of vanes.

Technical objects to be achieved by the present disclosure are not limited to the aforementioned technical objects, and other technical objects not described above may be evidently understood by a person having ordinary skill in the art to which the present disclosure pertains from the following description.

Solution to Problem

An indoor unit of an air conditioner is provided, and the indoor unit includes: a case installed indoors and having an outlet formed in a front or bottom thereof; and a vane module disposed at the case and guiding a flow direction of air discharged from the outlet, and the vane module includes: a first vane disposed in the outlet and rotatably installed on a forward side of a discharge direction of discharged air; a second vane disposed in the outlet and rotatably installed; two motor coupling parts disposed at both ends of the first vane and the second vane, respectively, wherein two motors each have at least a portion of which is exposed to the outlet; a vane motor assembled with at least one of the two motor coupling parts and providing a driving force; a drive link assembled to be rotatable rotatably to the motor coupling part, rotated by the driving force of the vane motor, and transmitting the driving force to the first vane and the second vane; a first vane link assembled to be relatively rotatable with the drive link and the motor coupling part on a forward side of the drive link to thereby rotate the first vane; and a second vane link assembled to be relatively rotatable with the drive link and the motor coupling part on a forward side of the drive link to thereby rotate the second vane, and the first vane link and the second vane link are assembled in a line with the drive link on a forward side of the drive link.

The vane module may further include a link installation part coupled to the case, and the motor coupling part is bent at the link installation part and is assembled to be relatively rotatable with the drive link, the first vane link, and the second vane link.

The vane motor may be installed on an opposite side to the outlet with respect to the motor coupling part.

The motor coupling part may include at least one guide hole indicating a path of rotation of the drive link, and the drive link may pass through the at least one guide hole and is assembled with the motor coupling part.

The motor coupling part may include the drive link coupling hole to which the drive link and the driving motor are coupled, a first vane link coupling hole with which the first vane link is assembled, and a second vane coupling hole with which the second vane is assembled.

The at least one guide hole may have an arc shape formed along a circumference of a circle at a predetermined distance from the drive link coupling hole as a center.

The at least one guide hole may include a first guide hole and a second guide hole, through which respective coupling shafts of the drive link pass, and the first guide hole and the second guide hole may each have an arc shape formed along a circumference of a circle at a predetermined distance from the drive link coupling hole as a center.

The first guide hole and the second guide hole may be formed to be symmetrical with each other with respect to the drive link coupling hole, and may be disposed to be spaced apart from each other by a predetermined distance at upper and lower portions.

An upper separation distance between the first guide hole and the second guide hole may be smaller than a lower separation distance therebetween.

The drive link may include: a core body; a core link shaft disposed at the core body, aligned with a core link coupling hole of the motor coupling part, and coupled to the vane motor; a first drive link shaft extending from the core body and rotatably coupled to the first vane; and a second drive link shaft extending from the core body and rotatably coupled to the second vane link.

The core body of the drive link may be disposed toward the vane motor in the motor coupling part, and the first drive link shaft and the second drive link shaft may pass through the first guide hole and the second guide hole, respectively.

The core link shaft of the drive link may protrude in an opposite direction to the first drive link shaft and the second drive link shaft.

The first vane may include: a first vane body extending long in a longitudinal direction of the outlet; and a first joint rib protruding upward from the first vane body, and assembled so that the drive link and the first vane link are relatively rotatable, and the first joint rib may include a first joint part assembled to be relatively rotatable with the first vane link, and a second joint part assembled to be relatively rotatable with the drive link.

The second vane may include: a second vane body elongated in the longitudinal direction of the outlet; a second joint rib protruding upward from the second vane body and rotatably coupled to the second vane link; and a pair of second vane shafts formed in the second vane body and rotatably coupled to the module body.

Only the first vane link may be located between the first joint rib and the motor coupling part, and only the second vane link may be located between the second joint rib and the motor coupling part.

The motor coupling part may include at least one guide groove indicating a path of rotation of the drive link, and the drive link may be inserted into the guide groove to be assembled with the motor coupling part.

The motor coupling part may include the drive link coupling hole formed in the guide groove and coupled to the drive link and the drive motor, a first vane link coupling hole with which the first vane link is assembled toward an outside of the guide groove, and a second vane coupling hole with which the second vane is assembled.

The at least one guide hole may be formed in a circle shape having a diameter of a predetermined distance from the drive link coupling hole as a center.

The drive link may include: a disk-shaped core body inserted into the guide groove; a core link shaft disposed at the core body, aligned with a core link coupling hole of the motor coupling part, and coupled to the vane motor; a first drive link shaft extending from the core body and rotatably coupled to the first vane; and a second drive link shaft extending from the core body and rotatably coupled to the second vane link.

The first drive link shaft and the second drive link shaft of the drive link may be formed in directions opposite to each other with respect to the core link shaft.

The first vane may be driven to rotate with four inflection points from the first vane to the drive motor, and the second vane may be driven to rotate with four inflection points from the second vane to the drive motor.

Advantageous Effects of Invention

In the present disclosure, it is possible to provide various modes of wind through a first vane and a second vane as an outlet module including a dual vane structure is included.

In addition, since a space occupied by the drive module is minimized when the first vane and the second vane constituting the dual vanes are simultaneously driven, it is possible to maximize a size of a vane itself, thereby increasing a maximum value of a flow rate and reducing a cost.

In addition, in the present disclosure, a wall surface forming a module body, the surface on which links connecting the respective vanes are connected in series, that is, arranged in a line on the same plane, in the minimized drive module, is formed as a link installation part, and thus, it is possible to minimize the size of the drive module. Accordingly, since an area of the drive module protruding toward the air passage is minimized, it is possible to minimize dew condensation. In addition, by minimizing the opening of the drive module for driving the dual vanes, unnecessary flow of air may be reduced, and thus, it is possible to minimize noise of the drive module.

MODE FOR THE INVENTION

Figure 1:
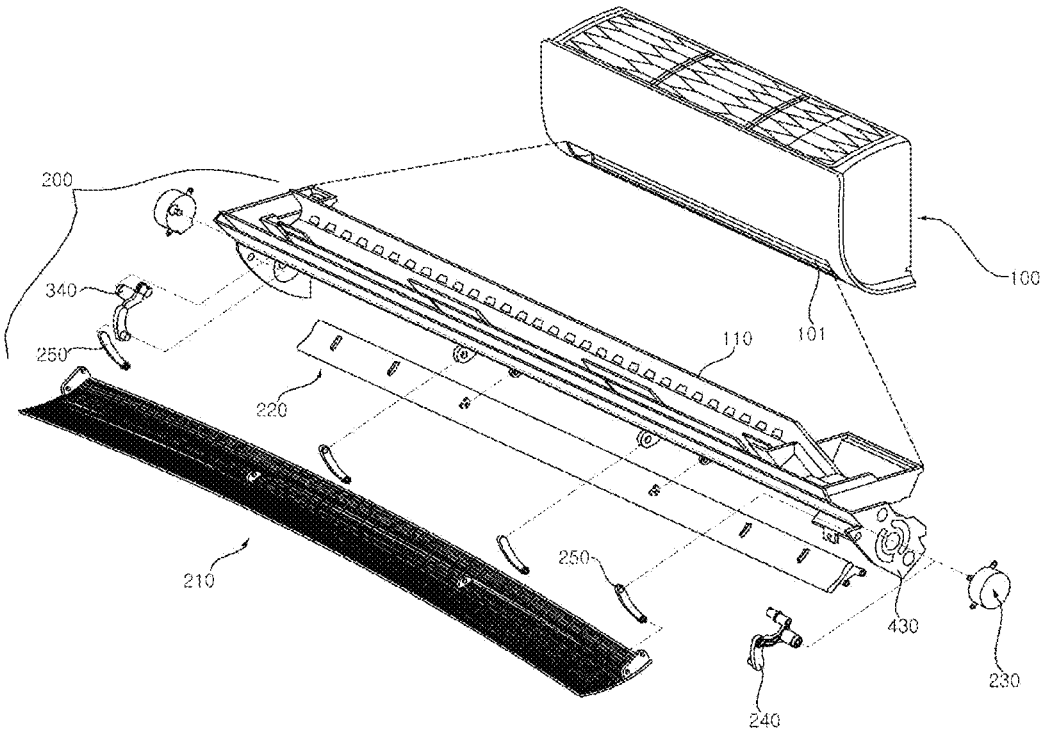
FIG. 1 is an exploded perspective view illustrating a coupling between an outlet and dual vanes of an indoor unit of an air conditioner according to an embodiment of the present disclosure.

In the following description, the terms "forward (F)," "rearward (R)," "leftward (Le)," "rightward (Ri)," "upward (U)," and "downward (D)," are defined as illustrated in the drawings, but these definitions are given only for clear understanding of the present disclosure, and the directions may be defined differently depending on the circumstances.

In the following description, the terms "first," "second," "third," and "fourth" are used only to avoid confusion between designated components, and do not indicate the sequence or importance of the components or the relationships between the components. For example, an invention including only a second component without a first component may also be implemented.

In the drawings, thicknesses or size of each component may be exaggerated, omitted, or schematically described for convenience in description and clarity. In addition, the size or area of each component does not fully match the actual size or area thereof.

In addition, angles or directions used to describe the structures of the present disclosure are based on those shown in the drawings. In the description of the structure in the specification, unless a reference point of an angle or angular positional relations in the structures of the present disclosure are clearly described, the related drawings may be referred to.

Advantages and features of the present disclosure, and implementation methods thereof will be clarified through following embodiments described with reference to the accompanying drawings. The present disclosure may, however, be embodied in different forms and should not be construed as limited to the embodiments set forth herein, and these embodiments are provided so that this disclosure will be thorough and complete, and will fully convey the scope of the present disclosure to those skilled in the art. Like reference numerals refer to like elements throughout.

Hereinafter, the present disclosure will be described in detail with reference to the accompanying drawings.

For the purpose of description, a direction in which air is discharged is defined as a forward direction, and the opposite direction is defined as a rearward direction. In addition, a ceiling side is defined as an upper side, and a floor is defined as a lower side.

Figure 2:
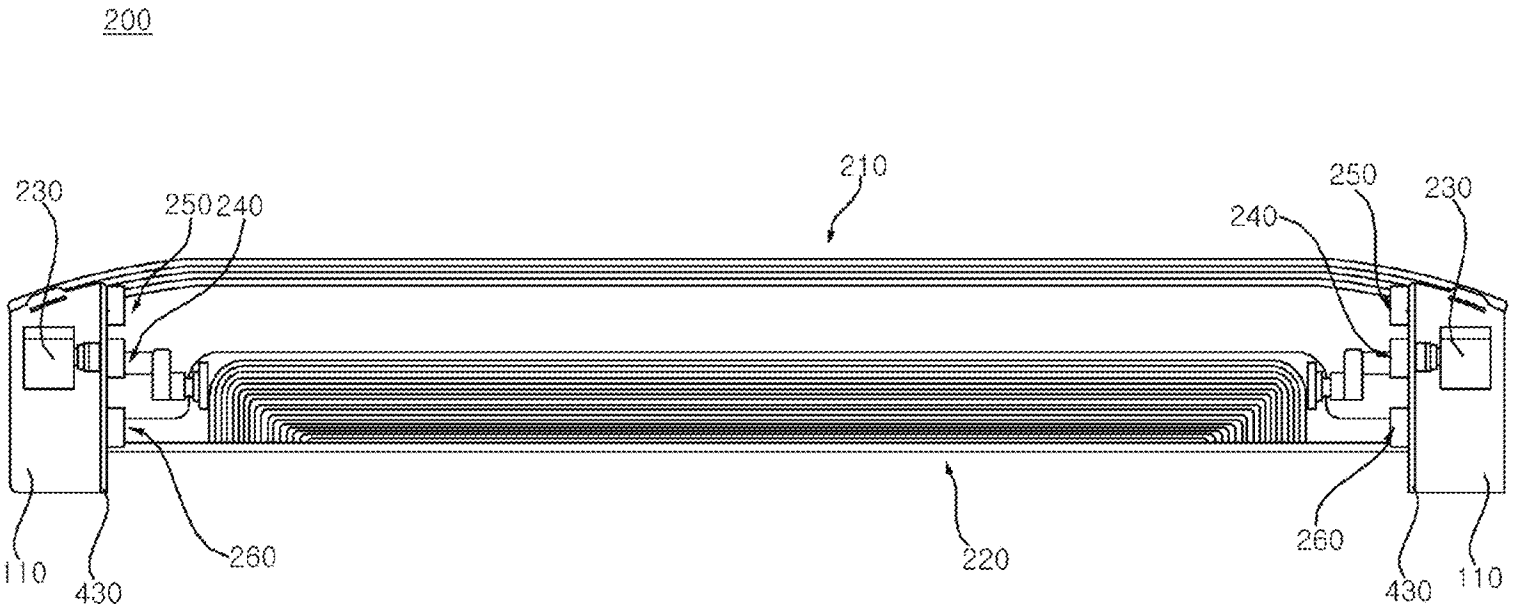
FIG. 2 is a plan view of the vane module shown in FIG. 1.

FIG. 1 is an exploded perspective view illustrating a coupling state between an outlet and dual vanes of an indoor unit of an air conditioner according to an embodiment of the present disclosure, and FIG. 2 is a plan view of the vane module shown in FIG. 1.

Referring to FIGS. 1 and 2, the indoor unit of the air conditioner according to the present disclosure includes a case 100, a heat exchanger (not shown), a blowing fan (not shown), and a vane module 200.

The case 100 includes an inlet (not shown) and an outlet 101. In the inlet (not shown), air is intaken through the inlet (not shown), and then is discharged through the outlet 101 through an internal air flow path. Air intaken through the inlet (not shown) passes through a heat exchanger (not shown) disposed inside the case 100. The heat exchanger (not shown) cools or heats air by exchanging heat with the air flowing through the case 100 through heat transfer. A blower fan (not shown) sucks air, allows the air to flow to the inside, and provides blowing force for discharging cooled or heated air through a heat exchanger (not shown).

The indoor unit of the air conditioner according to the exemplary embodiment of the present disclosure may be an indoor unit of a wall-mounted air conditioner including the case 100 hanging on a wall. In this case, the inlet (not shown) may be disposed at an upper side of the case 100. In addition, the outlet 101 may be disposed at a front or a lower side of the case 100. The inlet (not shown) and the outlet 101 may be each provided in plurality. In this case, the case 100 may have a long rectangular shape when viewed from the front.

Referring to FIG. 1, a vane for guiding a discharge flow of discharged air may be disposed in the outlet 101 according to the present disclosure. The vane may be disposed inside the outlet 101, may be disposed from the inside to the outside of the outlet 101, or may be disposed outside the outlet 101. Also, the vane may be disposed to cover the outlet 101 when the indoor unit is not in operation.

The outlet 101 according to the present disclosure may have an open shape in the form of an elongated rectangle as a whole. At this point, when the vane is disposed inside the outlet 101 or disposed from the inside to the outside of the outlet 101, a width of the vane in each longitudinal direction may be smaller than or equal to a width of the outlet 101. However, when the vane is disposed outside the outlet 101, a longitudinal width of the vane may be greater than a longitudinal width of the outlet 101.

the vane according to the present disclosure may be provided in plurality. When a plurality of vanes are disposed, the plurality of vanes may be disposed identically or differently from the inside to the outside of the outlet 101 or outside the outlet 101. In addition, each vane may have a different longitudinal width or breadth.

Two vanes according to the present disclosure may be disposed. In an embodiment according to the present disclosure, two vanes disposed as described above is hereinafter defined as dual vanes. In this case, one vane may have a longitudinal breadth or width greater than that of the other vane. The two vanes may be sequentially disposed at the front and rear, respectively, based on an air discharge direction of the outlet 101. In this case, one vane may be a main vane, and the other vane may be an auxiliary vane. In this case, one vane and the other vane may rotate together or independently.

In addition, the center of gravity of one vane and the other vanes may move together or independently. The two vanes may be controlled to rotate or move independently of each other, or may be controlled to rotate or move dependently of each other.

In this case, one vane may be a first vane 210, and the other vane may be a second vane 220.

The indoor unit of the air conditioner according to the present disclosure may include a vane module 200 installed on one side of the case 100 to guide a flow direction of air discharged from the outlet 101. The vane module 200 is located on the outlet 101 and is coupled to the case 100.

In this embodiment, the vane module 200 may be separated to a lower side of the case 100. That is, the vane module 200 may be disposed irrespective of the coupling structure of the case 100, and may be independently separated from the case 100.

When the vane module 200 is not in operation (when the indoor unit is stopped), the case 100 and the vane module 200 may be viewed as a single structure.

Hereinafter, the vane module 200, which is the main feature of the present disclosure, will be described with further reference to FIG. 2.

Each of the vane modules 200 is installed in a discharge flow path (not shown), and controls the flow direction of air discharged through the outlet 101.

The vane module 200 includes a link installation part 110, a first vane 210, a second vane 220, a vane motor 230, a drive link 240, a first vane link 250, and a second vane link 260.

The first vane 210, the second vane 220, the vane motor 230, the drive link 240, the first vane link 250, and the second vane link 260 are all installed at the link installation parts 110. The link installation part 110 is integrally installed in the case 100. That is, all of the components of the vane module 200 are modularized and installed at once in the case 100.

Since the vane module 200 is modularized, there is an advantage in that the assembly time may be shortened and it is easy to replace in case of failure.

In this embodiment, the vane motor 230 may be a step motor.

The vane module 200 includes: the first link installation part 110 disposed in the discharge port 101, located at the front or the lower side of the case 100, and assembled to be separable to the front or lower of the case 100; at least one vane 210, 220 having one side and the other side coupled to the link installation part 110 and relatively rotatable with respect to both sides of the link installation part 110; and the vane motor 230 installed in the link installation part 110 and providing a driving force to the vane.

Since the link installation part 110 is located at the front or the lower side of the case 100, only the vane module 200 may be separated from the case 100 while installed in the case 100.

In this embodiment, the link installation part 110 includes a first module body 410 and a second module body 420 at both side ends, and the first module body 410 and the second module body 420 are formed symmetrically. In this embodiment, a common configuration will be described by taking the first module body 410 as an example.

The first module body 410 and the second module body 420 are respectively fastened to the link installation part 110.

Specifically, the first module body 410 and the second module body 420 may be installed at the side ends, respectively.

Hence, the first module body 410 and the second module body 420 are disposed at the front side or the lower side of the case 100. When viewed in the installed state of the indoor unit, a fastening direction of the first module body 410 and the case 100 is from the lower side to the upper side, and a fastening direction of the second module body 420 and the cj1282ase 100 is also from the lower side to the upper side.

Due to this structure, the entire vane module 200 may be easily separated from the case 100 in a service stage.

When the link installation part 110 is separated from the case 100, the entire vane module 200 is separated to the lower side of the case 100.

The first module body 410 and the second module body 420 of the link installation part 110 include the motor coupling part 430 which provides one of side surfaces of the link installation part 110, and to which the vanes 210 and 220 are coupled. In this case, a module guide part (not shown) protruding from the motor coupling part 430 toward the vanes 210 and 220 and guiding a flow direction of air may be further formed.

The link installation part 110 may be fastened to the case 100 by a fastening member 401 (not shown). Unlike this embodiment, the link installation part 110 may be coupled to the case 100 through hook coupling, interference fitting, or the like.

The motor coupling part 430 is formed by bending from the link installation part 110, and the link installation part 110 may have an "L" shape, but is not limited thereto because the link installation part 110 may be implemented in various shapes.

In this embodiment, the link installation part 110 and the motor coupling part 430 are integrally manufactured through injection molding.

The motor coupling part 430 is disposed at a side surface toward the first vane 210 and the second vane 220 out of the side surfaces of the link installation part 110.

The motor coupling part 430 is assembled with the drive link 240, the first vane link 250, the second vane link 260, and the second vane 220, and provides a center of rotation to each of the drive link 240, the first vane link 250, the second vane link 260, and the second vane 220.

In this embodiment, in order to minimize vibration or noise caused by the first vane 210, the second vane 220, the vane motor 230, the drive link 240, the first vane link 250, the second vane link 260, and the like, the link installation part 110 is firmly fastened to the case 100.

A fastening member (not shown) for fixing the link installation part 110 is fastened from the lower side to the upper side, and may be separated from the upper side to the lower side.

In addition, module hooks may be further included, and in a case where the module hooks are included, even if the fastening members are disassembled, the vane module 200 may remain coupled to the case 100 by the module hooks.

When it is necessary to remove the vane module 200 due to repair or breakdown, the vane module 200 remains coupled to the case 100 even when the fastening member is removed. For this reason, an operator does not need to separately support the vane module 200 when the fastening member is disassembled.

Since the vane module 200 is primarily fixed by a module hook and secondary fixed by a fastening member, it is possible to significantly improve work convenience during a service.

The link installation part 110 is disposed horizontally, and the motor coupling part 430 is disposed vertically. In particular, when viewed in an installed state, the motor coupling part 430 protrudes downward from the link installation part 110.

The motor coupling part 430 of the first module body 410 and the motor coupling part 430 of the second module body 420 are disposed to face each other. The first vane 210, the second vane 220, the drive link 240, the first vane link 250, and the second vane link 260 are installed between the motor coupling part 430 of the first module body 410 and the motor coupling part 430 of the second module body 420.

Meanwhile, as shown in FIG. 2, the vane motor 230 is disposed at an outside of the motor coupling part 430 of the first module body 410 or disposed at an outside of the motor coupling part 430 of the second module body 420.

The vane motor 230 may be installed only in one of the first module body 410 and the second module body 420. This embodiment has been described that the vane motor is disposed in both of the first module body 410 and the second module body 420, but the present disclosure is not limited thereto.

The first vane 210, the second vane 220, the drive link 240, the first vane link 250, and the second vane link 260 are coupled between the first module body 410 and the second module body 420, thereby integrating the vane module 200 into one body.

Hereinafter, a detailed configuration of the vane module 200 according to an embodiment of the present disclosure will be described with reference to FIGS. 3 to 11.

Figure 3:
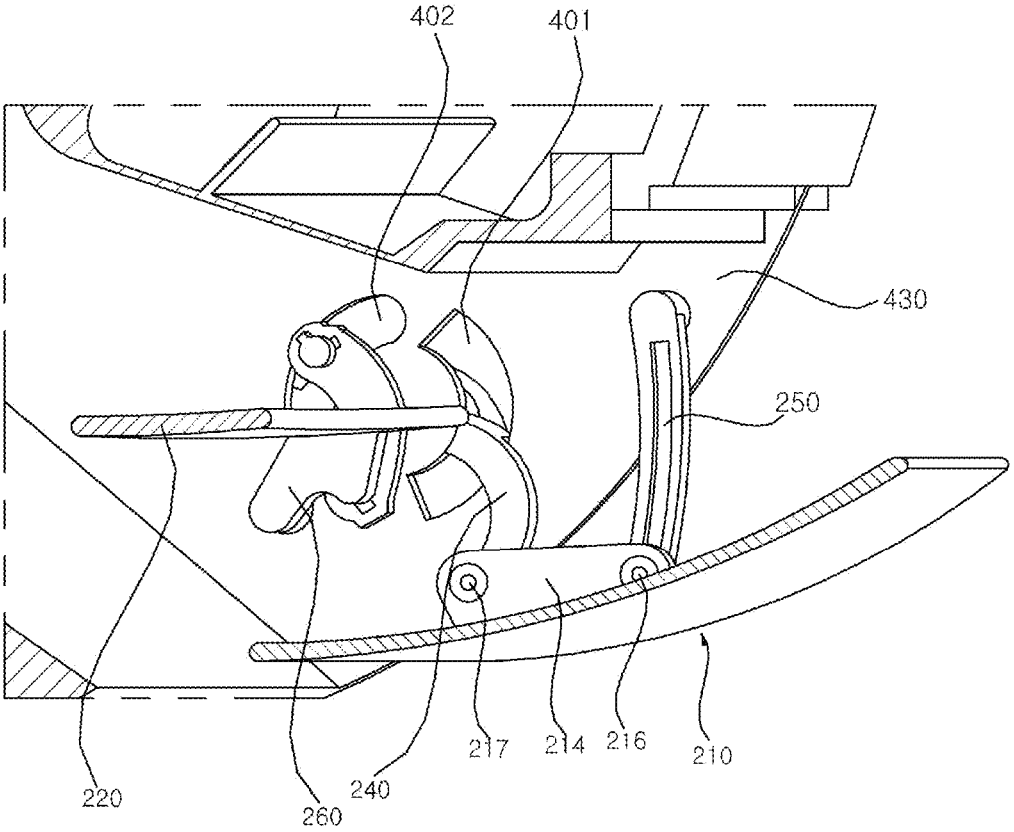
FIG. 3 is a perspective view illustrating an operation structure of a vane module according to an embodiment of the present disclosure.
Figure 4:
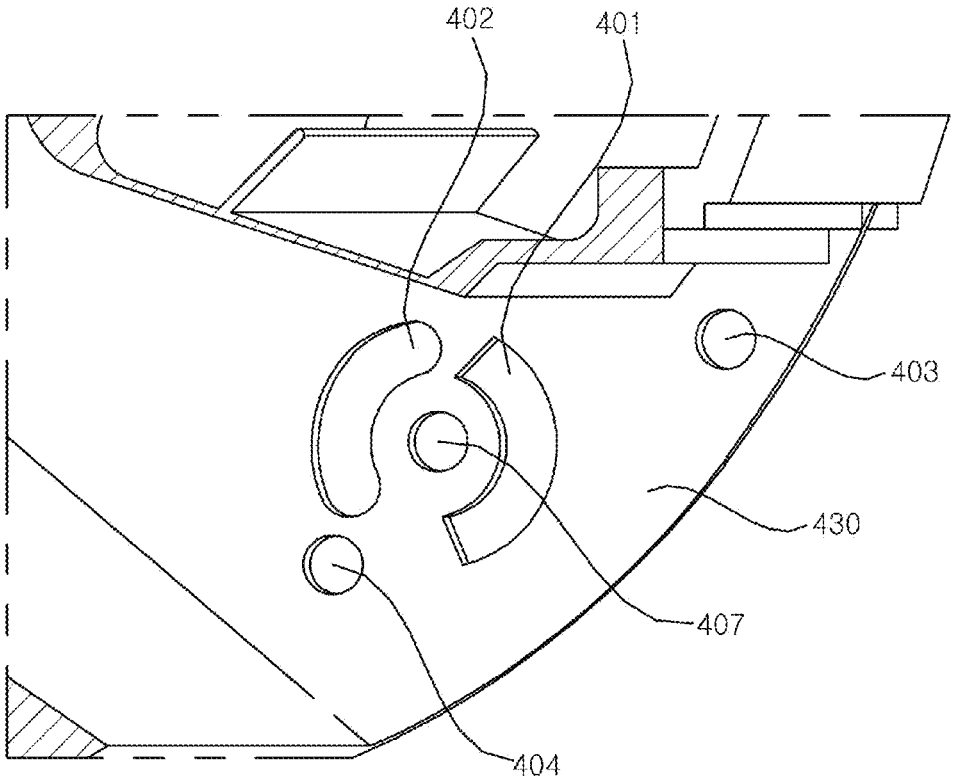
FIG. 4 is a front view of a module body of the vane module of FIG. 3.

FIG. 3 is a perspective view illustrating an operation structure of a vane module according to an embodiment of the present disclosure, and FIG. 4 is a front view of a module body of the vane module of FIG. 3.

Referring to FIG. 3, in the vane module 200 according to an embodiment of the present disclosure, the motor coupling part 430, which is a side surface of the module body 410, is disposed to face the first vane 210 and the second vane 220, and a plurality of openings for coupling the drive link 240, the first vane link 250, and the second vane link 260 are formed in each motor coupling part 430.

Specifically, the motor coupling part 430 has the following formed therein: a drive link coupling hole 407 assembled with the drive link 240 and providing a center of rotation to the drive link 240; a first vane link coupling hole 403 assembled with the first vane link 250 and providing a center of rotation to the first vane link 250; and a second vane coupling hole 404 assembled with the second vane 220 and providing a center of rotation to the second vane 220.

In addition, two guide holes 401 and 402 each formed in an arc shape along the circumference of a circle surrounding the drive link coupling hole 407 based on the drive link coupling hole 407 are included.

In this embodiment, the drive link coupling hole 407, the first vane link coupling hole 408, the second vane coupling hole 404, and the two guide holes 401 and 402 are each formed in the shape of a hole passing through the motor coupling part 430.

A motor shaft of the vane motor 230 and a shaft 221 of the second vane 220 are coupled in the drive link coupling hole 407.

A second vane shaft 221 of the second vane 220 is inserted into the second vane coupling hole 404.

One end of the first vane link 250 is inserted into the first vane link coupling hole 408 and is rotatably coupled thereto.

Regarding the drive link coupling hole 407, the first vane link coupling hole 408, and the second vane coupling hole 404, the drive link coupling hole 407 is formed in a central area of the drive link coupling hole 407 of the motor coupling part 430, the first vane link coupling hole 408 is disposed on an upper right side from the drive link coupling hole 407, and the second vane coupling hole 404 is disposed on a lower left side from the drive link coupling hole 407.

The sizes of the drive link coupling hole 407, the first vane link coupling hole 408, and the second vane coupling hole 404 may be different from one another, but may be determined according to the sizes of coupling shafts of the respective links 240, 250, and 260. For example, when the sizes of the coupling shafts of the respective links 240, 250, and 260 are the same, the diameters of the respective coupling holes 407, 408, and 404 may all be the same.

Meanwhile, the two guide holes 401 and 402 are formed in the motor coupling part 430 with the drive link coupling hole 407 as the center.

The two guide holes 401 and 402 are each formed in an arc shape along a circumference of a circle at a predetermined distance from the drive link coupling hole 407 as a center, as described above.

The two guide holes 401 and 402 each form a path in which each coupling shaft of the drive link 240 is installed and moved while rotating.

That is, the first guide hole 401 represents a path in which the first vane link coupling shaft 241 coupled to the first vane 210 of the drive link 240 is allowed to move by rotation of the vane motor 230, and the first guide hole 401 may be formed along an arc having a length smaller than a semicircle disposed on the right side of the drive link coupling hole 407.

The second guide hole 402 may be spaced apart from the first guide hole 401 to face the first guide hole 401 and form symmetry, and the second guide hole 402 represent a path in which the second vane link coupling shaft 242 coupled to the second vane link 260 of the drive link 240 is allowed to move by rotation of the vane motor 230.

The second guide hole 402 is disposed on the left side of the drive link coupling hole 407 and may be formed along an arc having a length smaller than a semicircle.

The first guide hole 401 and the second guide hole 402 may have a similar size and a similar shape, that is, an arc shape, and may be symmetrical to each other, but not limited thereto. That is, a length of the second guide hole 402 may be shorter than a length of the first guide hole 401 depending on a radius.

Figure 7:
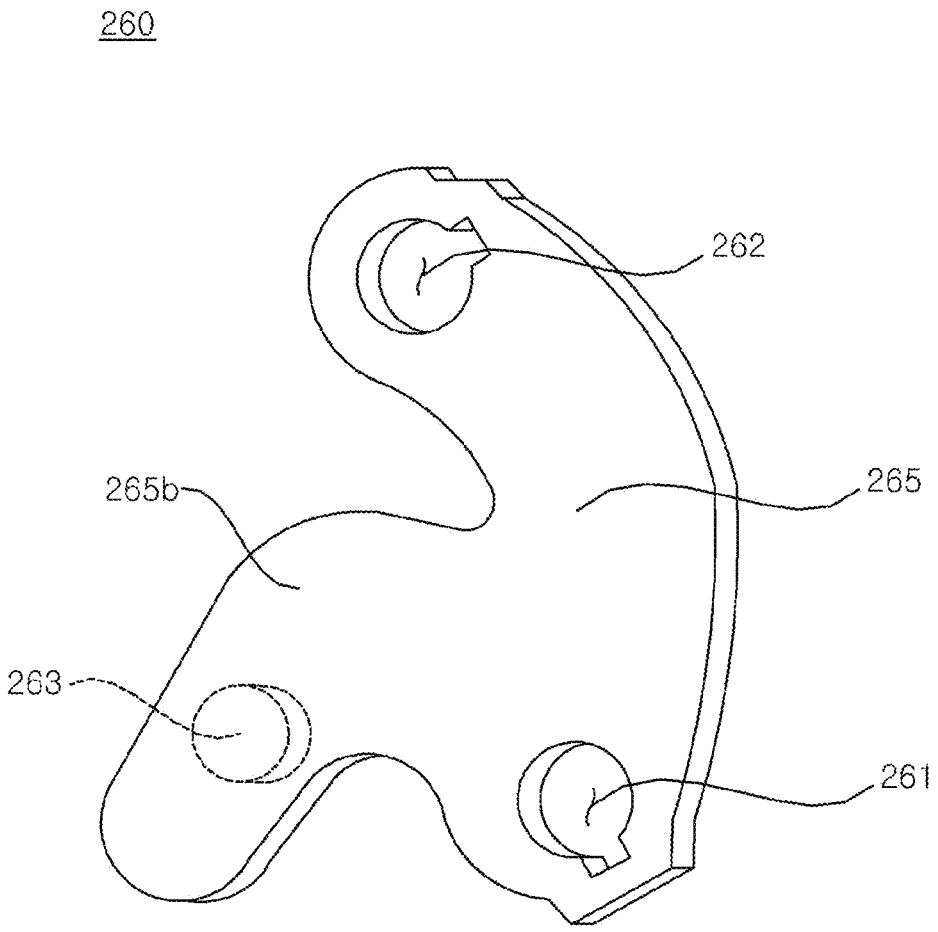
FIG. 7 is a perspective view of a second vane link of the vane module of FIG. 3.

In addition, both ends of the first guide hole 401 may be formed flat as shown in FIG. 7, but both ends of the second guide hole 402 may be chamfered in a round shape.

A separation distance may be formed between the first guide hole 401 and the second guide hole 402, and the separation distance is formed at each of upper and lower portions.

A separation distance formed at the upper portions of the first guide hole 401 and the second guide hole 402 may be shorter than a separation distance formed at the lower portions thereof, but not limited thereto.

The vane motor 230 is assembled with the outside of the motor coupling part 430. For assembling of the vane motor 230, the drive link 240 is formed outwardly from the motor coupling part 430, and a rotational shaft of the vane motor 230 is rotatably coupled to a central shaft of the drive link 240.

As such, since a link capable of being directly and rotatably coupled to each link and the vanes 210 and 220 is formed in the shape of a hole in the motor coupling part 430, which is one surface of the link installation part 110, a coupling thickness as large as a thickness of the case of the motor coupling part 430 is required, and thus, the thickness is not additionally increased by protrusion required for link coupling.

Hereinafter, each component of FIG. 3 will be described in detail.

Figure 5:
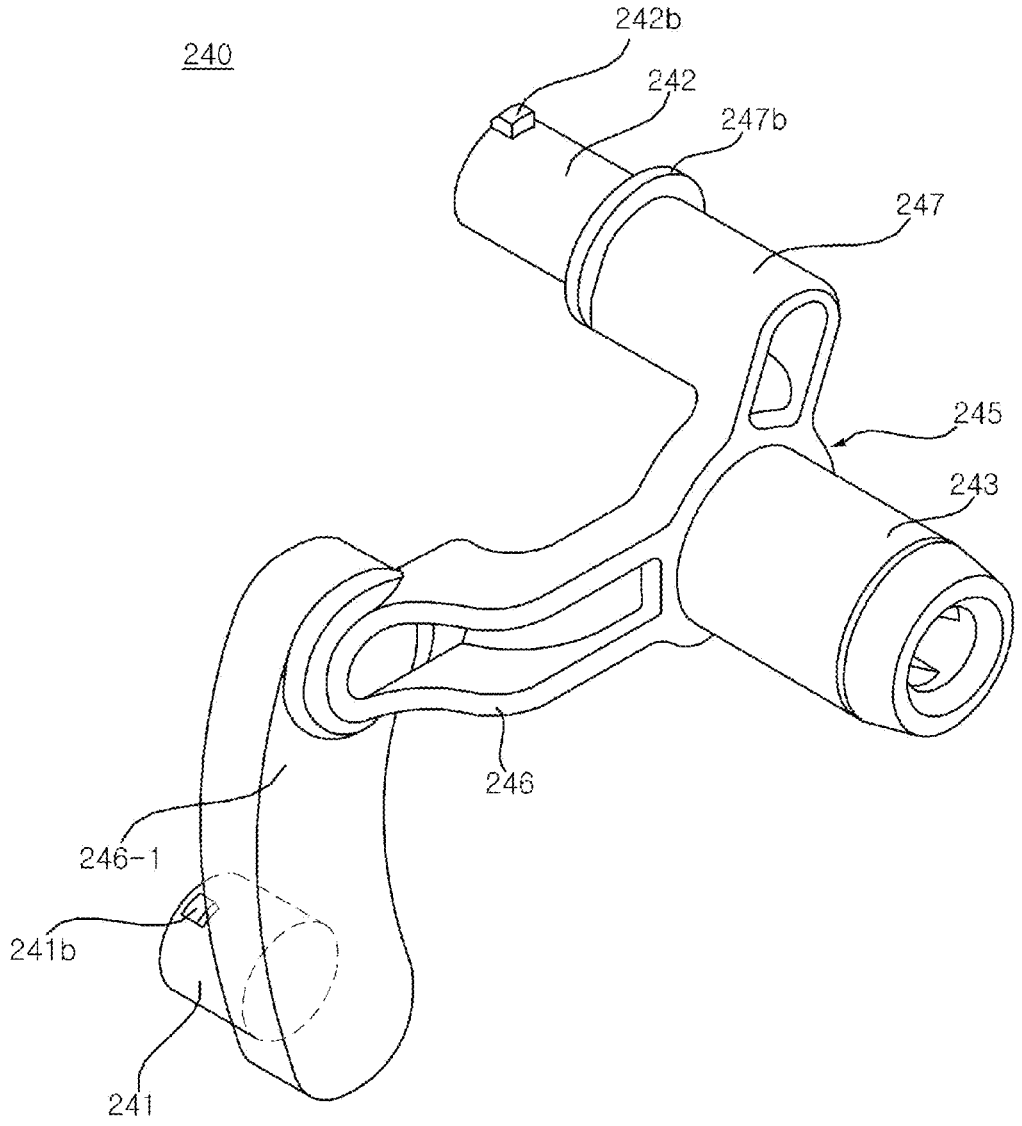
FIG. 5 is a perspective view of a drive link of the vane module of FIG. 3.

FIG. 5 is a perspective view of a drive link of the vane module of FIG. 3.

Referring to FIGS. 3 and 5, the drive link 240 according to an embodiment of the present disclosure is directly connected to the vane motor 230. A motor shaft (not shown) of the vane motor 230 is directly coupled to the drive link 240, and an amount of rotation of the drive link 240 is determined by an angle of rotation of the shaft of the vane motor 230.

The drive link 240 passes through the motor coupling part 430 and is assembled with the second vane link 260 and the first vane 210 at a front surface of the motor coupling part 430 and assembled with the vane motor 230 at a rear surface of the motor coupling part 430.

The drive link 240 includes: a drive link body 245; a first drive link shaft 241 disposed at the drive link body 245 and rotatably coupled to the first vane 210; a core link shaft 243 disposed at the drive link body 245 and aligned with the drive link coupling hole 407 of the motor coupling part 430 to be rotatably coupled by the second vane 220; and a second drive link shaft 242 disposed at the drive link body 245 and rotatably coupled to the second vane link 260.

The drive link body 245 includes a first drive link body 246, a second drive link body 247, and a core body 248.

The core link shaft 243 is disposed at the core body 248, the first drive link shaft 241 is disposed at the first drive link body 246, and the second drive link shaft 242 is disposed at the second drive link body 247.

The core body 248 connects the first drive link body 246 and the second drive link body 247. The first drive link body 246, the second drive link body 247, and the core link shaft 243 are connected to the core body 248.

The core link shaft 243 protrudes from the core body 248 toward the vane motor 230.

The core link shaft 243 is rotatably assembled with the motor coupling part 430. The core link shaft 243 is aligned with the drive link coupling hole 407 formed in the motor coupling part 430. The core link shaft 243 may be relatively rotatable while aligned with the drive link coupling hole 407.

The first drive link shaft 241 and the second drive link shaft 242 protrude in a direction opposite to the core link shaft 243, that is, toward a front surface where the first vane 210 and the second vane 220 are disposed.

The core body 248 of the drive link 240 is disposed on the outside (a vane motor side) of the motor coupling part 430, and only the core link shaft 243 of the drive link 240 is disposed on the outside (a vane motor side) of the motor coupling part 430.

The first drive link body 246 and the second drive link body 247 pass through the motor coupling part 430 and are disposed in an inside (a vane side)of the motor coupling part 430.

The core link shaft 243 is formed in a cylindrical shape which is empty inside. The motor shaft 231 of the vane motor 230 is inserted into a hollow formed inside the core link shaft 243.

The core link shaft 243 is aligned with the drive link coupling hole 407. The core link shaft 243 and the drive link coupling hole 407 are simultaneously penetrated by the second vane shaft 221, and the core body 248 may be in close contact with the motor coupling part 430.

When a frictional force is generated as a result of excessively close contact between the core body 248 and the motor coupling part 430, rotation of the drive link 240 is disturbed. In order to prevent the disturbance, a protrusion protruding from a surface of the core body 248 is provided in plurality. The protrusion protrudes in a direction opposite to the core link shaft 243. The protrusion may be disposed in plurality along an edge of the core link shaft 243.

There is no particular restriction on the shapes of the first drive link body 246 and the second drive link body 247. The first drive link body 246 and the second drive link body 247 may be formed in a straight or curved shape, but a length of the second drive link body 247 may be set from the first drive link body 246 to be identical to as a maximum distance (a diameter of an imaginary circle) between the first and second guide holes 401 and 402 of the motor coupling part 430.

The first drive link body 246 is formed longer than the second drive link body 247. The first drive link shaft 241 is rotatably assembled with the first vane 210. The second drive link shaft 242 is rotatably assembled with the second vane link 260.

The first drive link body 246 is connected to the core body 248 and extends in a direction orthogonal to the core link shaft 243. The first drive link body 246 extends in a direction parallel to the thickness of the core body 248. A first drive link shaft installation part 246-1 bent at an extended portion of the first drive link body 246 and extending downwardly is formed.

The first drive link shaft 241 is formed at an end portion of the first drive link shaft installation part 246-1.

The first drive link shaft installation part 246-1 is formed to be wider than a diameter of the first drive link shaft 241. The first drive link shaft installation part 246-1 may be in close contact with the first vane 210 and may support the first vane 210.

The first drive link shaft 241 and the first drive link shaft installation part 246-1 pass through the first guide hole 401 and protrude toward the first vane 210 (in a direction opposite to the core link shaft).

The first drive link shaft 241 is a shaft rotation structure for rotation with the first vane 210.

The first drive link shaft 241 protrudes from the first drive link shaft installation part 246-1 toward the first vane 210, and includes a link shaft engaging part 241*b* protruding from the first drive link shaft 241 and forming mutual engagement with a first joint part 216 of the first vane 210 to be described later.

The first drive link shaft 241 provides a shaft rotation structure in a cylindrical shape.

The link shaft engaging part 241*b* is disposed at an outer side surface of the first drive link shaft 241 and protrudes outward. The link shaft engaging part 241*b* is disposed at an end portion of the first drive link shaft 241.

A protrusion may be formed in the first drive link shaft installation part 246-1. The protrusion is in close contact with an outer surface of the first vane 210, and supports the first vane 210. The protrusion may minimize an assembling error of the first vane 210.

The second drive link body 247 is connected to the core body 248 and extends in a direction orthogonal to the core link shaft 243. The second drive link body 247 extends in a direction parallel to the thickness of the core body 248. A second drive link shaft installation part 247*b* in which the second drive link shaft 242 is disposed is formed at one end of the second drive link body 247.

The second drive link shaft installation part 247*b* is formed in a disk shape. The second drive link shaft installation part 247*b* is formed to be wider than a diameter of the second drive link shaft 242.

The second drive link shaft installation part 247*b* is disposed at the second drive link body 247.

In this embodiment, the second drive link body 247 is orthogonal from the core body 248 and extends in a direction opposite to the core link shaft 243.

The second drive link shaft 242 is formed in a cylindrical shape. The second drive link shaft 242 protrudes from the second drive link shaft installation part 247*b* in a direction opposite to the core link shaft 243 and passes through the second guide hole 402 of the motor coupling part 430.

The link shaft engaging part 242*b* is formed in an outer side surface of the second drive link shaft 242. The link shaft engaging part 242*b* forms mutual engagement with the second vane link 260.

A protrusion may also be formed in the second drive link shaft installation part 247*b*.

The first drive link body 246 and the second drive link body 247 may form a predetermined angle E. An imaginary straight line connecting the first drive link shaft 241 and the core link shaft 243 and an imaginary straight line connecting the core link shaft 243 and the second drive link shaft 242 may form the predetermined angle E therebetween. The angle E may be formed to be greater than 90 degrees and less than 180 degrees.

The first drive link shaft 241 provides a structure in which the drive link body 245 and the first vane 210 are relatively rotatable. In this embodiment, the first drive link shaft 241 is formed integrally with the drive link body 245.

The core link shaft 243 provides a structure in which the drive link body 245 and the motor coupling part 430 are relatively rotatable. In this embodiment, the core link shaft 243 is formed integrally with the drive link body 245.

The second drive link shaft 242 provides a structure in which the second vane link 260 and the drive link 240 are relatively rotatable. In this embodiment, the second drive link shaft 242 is formed integrally with the drive link body 245. Unlike this embodiment, the second drive link shaft 242 may be manufactured integrally with the second vane link 260.

In this embodiment, the second drive link shaft 242 is disposed at the second drive link body 247. The second drive link shaft 242 is disposed on a side opposite to the first drive link shaft 241 with respect to the core link shaft 243.

Figure 6:
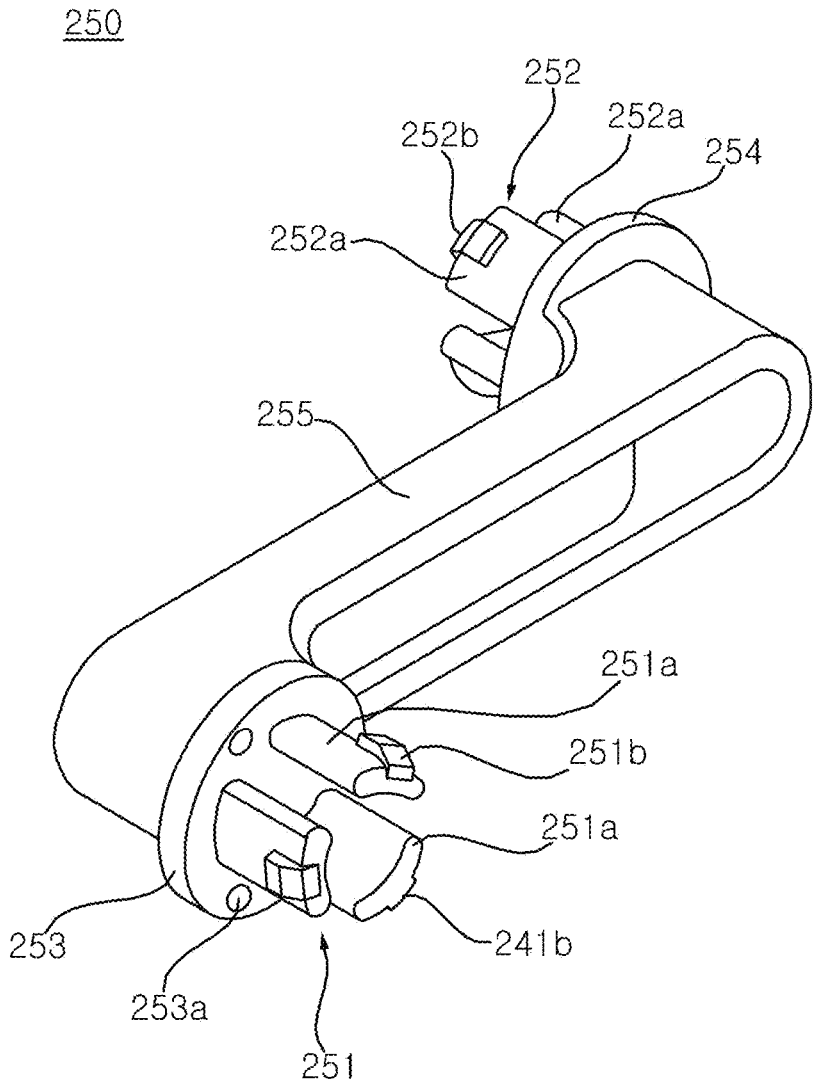
FIG. 6 is a perspective view of a first vane link of the vane module of FIG. 3.

FIG. 6 is a perspective view of a first vane link of the vane module of FIG. 3.

In this embodiment, the first vane link 250 is formed of a solid material and is formed in a straight shape. Unlike this embodiment, the first vane link 250 may be formed in a curved shape.

The first vane link 250 includes: a first vane link body 255 formed of a solid material; a 1-1 vane link shaft 251 disposed on one side of the first vane link body 255, assembled with the first vane 210, and relatively rotatable with the first vane 210; a 1-1 vane link shaft installation part 253 disposed on one side of the first vane link body 255, formed to extend from the first vane link body 255 toward the first vane 210, and having the 1-1 vane link shaft 251 disposed thereon; and a 1-2 first vane link shaft 252 disposed on the other side of the first vane link body 255, assembled with the motor coupling part 430, and relatively rotatable with the link installation part 110.

In addition, a 1-2 vane link shaft installation part 254 at which the 1-2 vane link shaft 252 is disposed.

The 1-1 vane link shaft 251 protrudes toward the first vane 210. The 1-1 vane link shaft 251 may be assembled with the first vane 210 and relatively rotatable with the first vane 210.

The 1-2 vane link shaft 252 is assembled with the motor coupling part 430 of the link installation part 110. Specifically, the 1-2 vane link shaft 252 may be assembled with the first vane link coupling hole 403, and may be relatively rotatable with the first vane link coupling hole 403.

The 1-1 vane link shaft 251 and the 1-2 vane link shaft 252 protrude in directions opposite to each other. Thus, the 1-1 vane link shaft installation part 253 and the 1-2 vane link shaft installation part 254 are disposed to face in directions opposite to each other.

In this embodiment, a longitudinal direction of the first vane link body 255 and an arrangement direction of the 1-1 vane link shaft installation part 253 are orthogonal to each other, and the longitudinal direction of the first vane link body 255 and an arrangement direction of the 1-2 vane link shaft installation parts 254 are orthogonal to each other.

The 1-1 vane link shaft installation part 253 is formed in a ring shape. The 1-1 vane link shaft installation part 253 is formed to be wider than a diameter of the 1-1 vane link shaft 251. The 1-1 vane link shaft installation part 253 may be in close contact with the first vane 210 and may support the first vane 210.

The 1-1 vane link shaft 251 is a shaft rotation structure for rotation with the first vane 210.

The 1-1 vane link shaft 251 includes: a link shaft body 251*a* protruding from the 1-1 vane link shaft installation part 253 toward the first vane 210, and formed in plurality; and a link shaft engaging part 251*b* protruding from the link shaft body 251*a* and forming mutual engagement with a second joint part 217 of the first vane 210 to be described later.

In this embodiment, the link shaft body 251*a* is provided as three link shaft bodies, the three link shaft bodies 251*a* are disposed to be spaced apart from each other. Each link shaft body 251*a* protrudes from the 1-1 vane link shaft installation part 253. The three link shaft bodies 251*a* are gathered to provide a shaft rotation structure in a cylindrical shape.

The link shaft engaging part 251*b* is disposed at each link shaft body 251*a*. The link shaft engaging part 251*b* is disposed at an outer side surface of a corresponding link shaft body 251*a*, and protrudes outward. The link shaft engaging part 251*b* is disposed at an end portion of the corresponding link shaft body 251*a*.

A joint part to be described later is fitted between the link shaft engaging part 251*b* and the 1-1 vane link shaft installation part 253.

When the 1-1 vane link shaft 251 and the joint part are assembled, the link shaft body 251*a* may be deformed and inserted into the second joint part 217. After passing through the second joint part 217, the link shaft body 251*a* is returned to its original state.

A protrusion 253*a* may be formed in the 1-1 vane link shaft installation part 253. The protrusion 253*a* is in close contact with an outer surface of the joint part 217 and supports the joint part 217. The protrusion 253*a* may minimize an assembling error of the first vane 210 and the joint part 217.

Since the configuration of the 1-1 vane link shaft 251 and the configuration of the 1-2 vane link shaft 252 are the same, a detailed description thereof will be omitted.

The 1-2 vane link shaft 252 includes: a link shaft body 252*a* protruding from the 1-2 vane link shaft installation part 254 toward a link installation part 404 (specifically, the first vane link coupling hole 403), and formed in plurality; and a link shaft engaging part 252*b* protruding from the link shaft body 252*a* and forming mutual engagement with the first vane link coupling hole 403.

FIG. 7 is a perspective view of a second vane link of the vane module of FIG. 3.

In this embodiment, the second vane link 260 is made of a solid material, is elongated in a curved shape, and has a shape protruding to one side. Unlike this embodiment, the first vane link 250 may be formed in a straight shape.

The second vane link 260 includes: a second vane link body 265; a 2-1 vane link hole 261 disposed at one end in a longitudinal direction of the second vane link body 265, assembled with the second vane 220, and relatively rotatable with the second vane 220; a 2-2 vane link hole 262 disposed at the other end in the longitudinal direction of the second vane link body 265 (an upper portion of the second vane link body), assembled with the drive link 240 (specifically, the second drive link shaft 242), and relatively rotatable with the drive link 240; and a second vane link shaft 263 formed in an area protruding to one side in the longitudinal direction of the second vane link body 265 and assembled with the second vane link installation hole 404 of the link installation part 404.

In this embodiment, the 2-1 vane link hole 261 and the 2-2 vane link hole 262 are each formed in the shape of a hole passing through the second vane link body 265. The 2-2 vane link hole 262 and the second drive link shaft 242 are assembled with each other to provide a relatively rotatable shaft rotation structure.

When any one of the 2-2 vane link hole 262 and the second drive link shaft 242 is formed in the shape of a shaft, the other one may be formed in the shape of a hole or a boss providing a center of rotation.

Such substitution of configuration is possible for all components coupled with the drive link 240, the first vane link 250, and the second vane link 260 and capable of being relatively rotatable, and an example of variation thereof will not be additionally described in detail.

The 2-1 vane link hole 261 may be assembled with the second vane 220 and relatively rotatable with the second vane 220.

The 2-1 vane link hole 261 is a shaft rotation structure for relative rotation with the second vane 220. The 2-1 vane link hole 261 is formed in a cylindrical structure. A link shaft engaging part (not shown) may be formed in an outer circumferential surface of the 2-1 vane link hole 261. The link shaft engaging part forms mutual engagement with the second vane 220.

The second vane 220 passes through the 2-1 vane link hole 261 and is assembled to be rotatable.

In this embodiment, the 2-2 vane link hole 262 is formed in the shape of a hole passing through the second vane link body 265. When the second drive link shaft 242 of the drive link 240 is rotated after passing through the 2-2 vane link hole 262, the second vane link 260 and the second drive link shaft 242 are assembled and prevented from being separated in the insertion direction of the second drive link shaft 242. The second drive link shaft 242 may be relatively rotatable in a state of being assembled with the 2-2 vane link hole 262.

Meanwhile, the second drive link shaft 24 is formed in an area 165*b* protruding to one side in the longitudinal direction of the second vane link body 265, and may be formed to be disposed on a straight line with the 2-2 vane link hole 262.

The second drive link shaft 242 has the same or similar structure as that of other link shafts, and is assembled with the second vane link installation hole 404 of the motor coupling part 430 to be rotatable.

Hereinafter, the form of the dual vanes including the first and second vanes will be described with reference to FIGS. 8 to 11.

Figure 8:
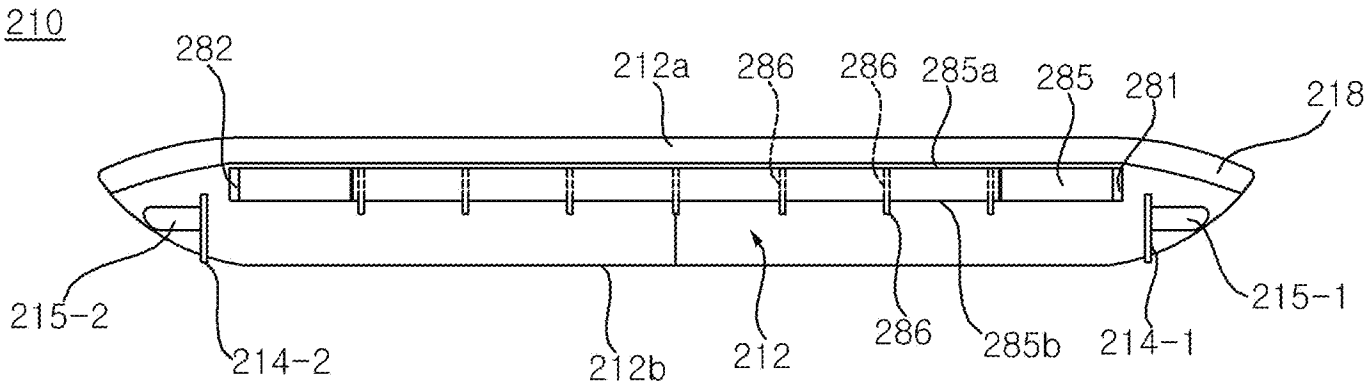
FIG. 8 is a perspective view of the first vane shown in FIG. 3.
Figure 9:
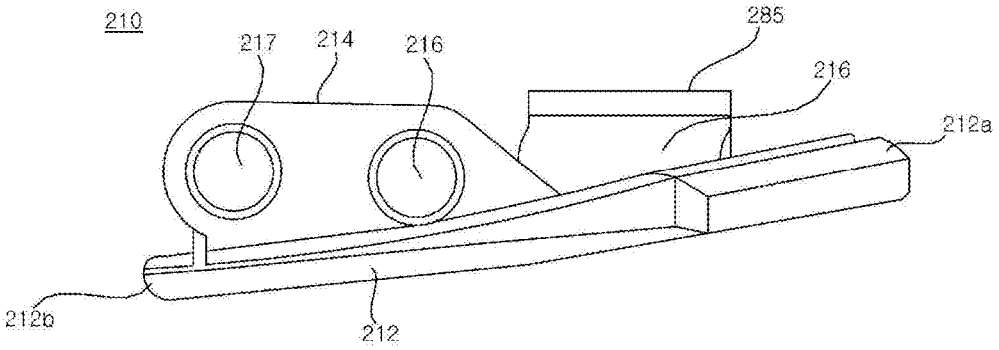
FIG. 9 is a side view of the first vane shown in FIG. 3.
Figure 10:
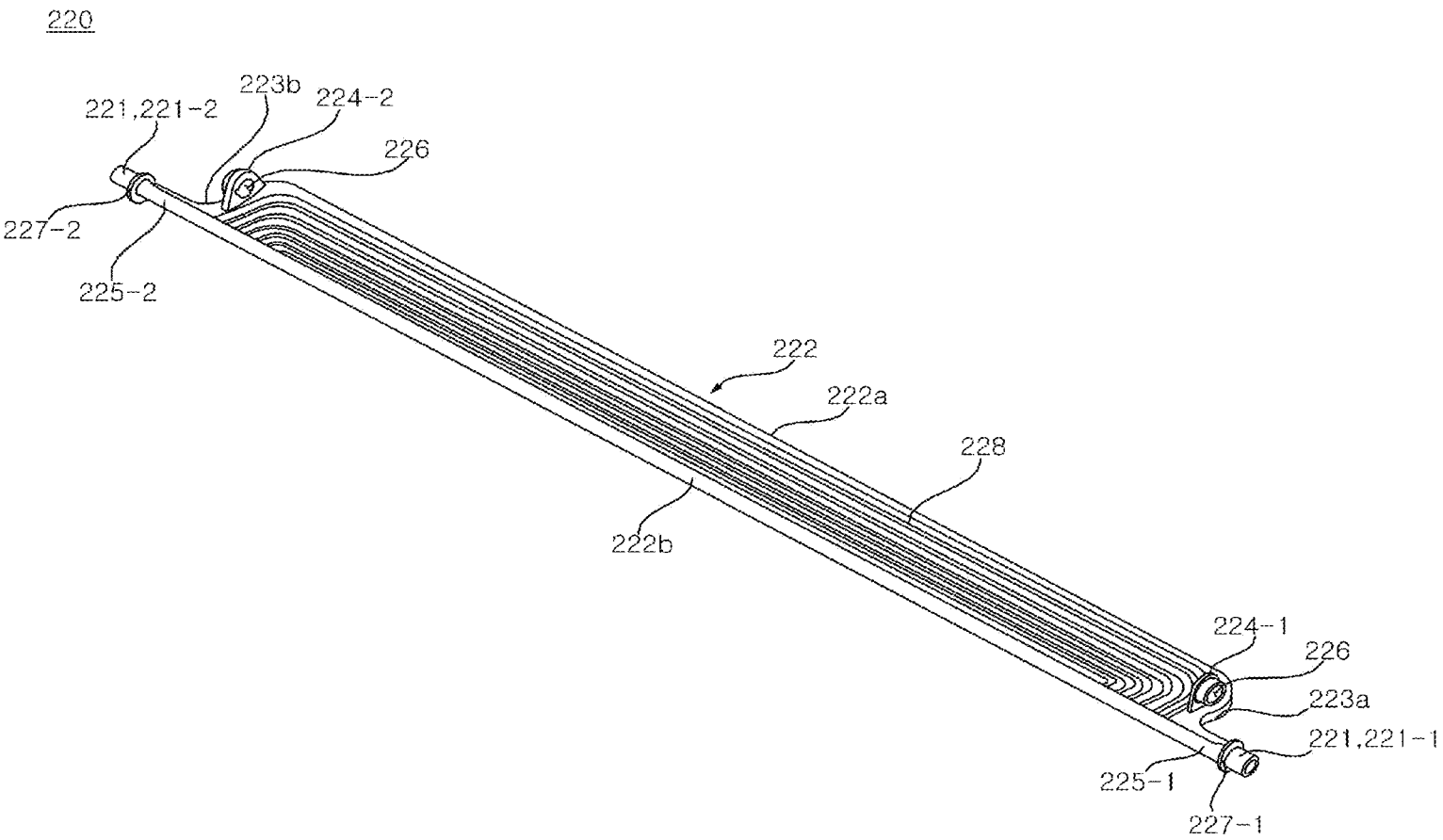
FIG. 10 is a perspective view of the second vane shown in FIG. 3.
Figure 11:
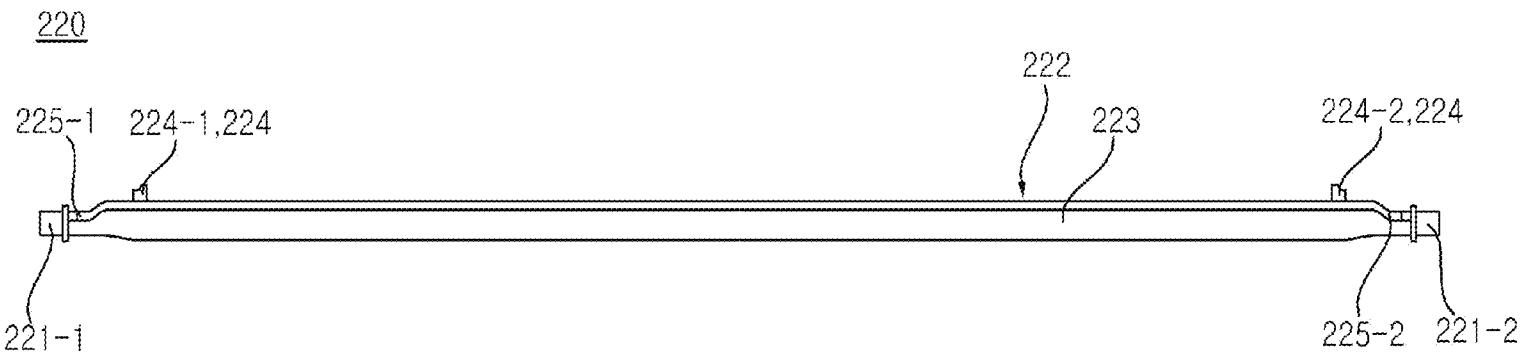
FIG. 11 is a front view of the second vane shown in FIG. 3.

FIG. 8 is a perspective view of the first vane shown in FIG. 3, FIG. 9 is a side view of the first vane shown in FIG. 3, FIG. 10 is a perspective view of the second vane shown in FIG. 3, and FIG. 11 is a front view of the second vane shown in FIG. 3.

For the purpose of description, a direction in which air is discharged is defined as a forward direction, and the opposite direction is defined as a rearward direction. In addition, a ceiling side is defined as an upper side, and a floor is defined as a lower side.

In this embodiment, the first vane 210 and the second vane 220 are disposed to control a flow direction of air discharged from the outlet 101. The relative arrangement and relative angle of the first vane 210 and the second vane 220 change depending on each step of the vane motor 230. In this embodiment, the first vane 210 and the second vane 220 are paired according to each step of the vane motor 230 to provide six discharge steps.

The discharging steps are defined as states in which the first vane 210 and the second vane 220 do not move but are fixed. As an opposite concept to this, a moving step may be provided in this embodiment. The moving step is defined as an airflow provided while the six discharge steps are combined and the first vane 210 and the second vane 220 are in operation.

Referring to FIGS. 8 and 9, the first vane 210 is disposed between the motor coupling part 430 of the first module body 410 and the motor coupling part 430 of the second module body 420.

When the indoor unit is not in operation, the first vane 210 covers most of the outlet 210. Unlike this embodiment, the first vane 210 may be manufactured to cover the entire outlet 210.

The first vane 210 is coupled to the drive link 240 and the first vane link 250.

The drive link 240 and the first vane link 250 are respectively disposed on one side and the other side of the first vane 210.

The first vane 210 is rotatable relatively to each of the drive link 240 and the first vane link 250, respectively.

When it is necessary to distinguish the positions of the drive link 240 and the first vane link 250, a drive link 240 coupled to the first module body 410 is defined as a first drive link, and a first vane link 250 coupled to the first module body 410 is defined as a 1-1 vane link. The drive link 240 coupled to the second module body 420 is defined as a second drive link, and the first vane link 250 coupled to the second module body 420 is defined as a 1-2 vane link.

The first vane 210 includes a first vane body 212 formed to be elongated in a longitudinal direction of the outlet 101, and a joint rib 214 protruding upward from the first vane body 212 and coupled to the drive link 240 and the first vane link 250.

The first vane body 212 controls a direction of air discharged along the discharge flow path 104. The discharged air may collide with the upper or lower surface of the first vane body 212, so that a flow direction may be guided. The discharge direction of the air and the longitudinal direction of the first vane body 212 are orthogonal to or cross each other.

A bottom surface of the first vane body 212 is formed in a smooth flat or curved surface, and various structures including the joint rib 214 are disposed on the upper surface. The plane of the first vane body 212 corresponds to the shape of the outlet 101.

The joint rib 214 is an installation structure for coupling the drive link 240 and the first vane link 250. The joint rib 214 is disposed at both of one side and the other side of the first vane 210.

The joint rib 214 is formed to protrude upward from an upper surface of the first vane body 212. The joint rib 214 is formed along the flow direction of the discharged air, and minimizes resistance with the discharged air. So, the joint rib 214 is orthogonal to or cross the longitudinal direction of the first vane body 212.

The joint rib 214 is formed to have a low height in a direction (forward direction) in which the air is discharged, and a high height in a direction (rearward direction) in which the air is introduced. In this embodiment, the joint rib 214 is formed to have a high height at a side to which the drive link 240 is coupled, and a low height at a side to which the first vane link 250 is coupled.

The joint rib 214 includes a second joint part 217 rotatably coupled to the drive link 240, and a first joint part 216 rotatably coupled to the first vane link 250.

The joint rib 214 may be manufactured integrally with the first vane body 212.

In this embodiment, the first joint part 216 and the second joint part 217 are each formed in the shape of a hole and pass through the joint rib 214. The first joint part 216 and the second joint part 217 have a structure capable of shaft-coupling or hinge-coupling, and may be deformed into various shapes.

The second joint part 217 is positioned higher than the first joint part 216 when viewed from the front.

The second joint part 217 is located on a rearward side of the first joint part 216. The first drive link shaft 241 is assembled with the second joint part 217. The second joint part 217 and the first drive link shaft 241 are assembled to be relatively rotatable. In this embodiment, the first drive link shaft 241 passes through the second joint part 217 and is assembled.

The first joint part 216 is assembled with the 1-1 vane link shaft 251.

The first joint part 216 and the 1-1 vane link shaft 251 are assembled to be relatively rotatable. In this embodiment, the 1-1 vane link shaft 251 passes through the first joint part 216 and is assembled therewith.

When viewed from above, the drive link 250 and the first vane link 250 are disposed between the joint rib 214 and the motor coupling part 430. In this embodiment, an interval between the first joint part 216 and the second joint part 217 is narrower than an interval between the core link shaft 243 and the 1-2 vane link shaft 252.

Two joint ribs 214 are disposed at the first vane 210. When it is necessary to distinguish the two joint ribs 214 disposed at the first vane 210, a joint rib 214 disposed on the left side of the vane module when viewed from the front is defined as a 1-1 joint rib 214-1, and a joint rib 214 disposed on the right side of the vane module is defined as a 1-2 joint rib 214-2.

The left joint part 214-1 and the right joint part 214-2 of the first vane 210 are disposed in parallel.

The first vane 210 has a concave groove 215-1 formed on an outside of the 1-1 joint rib 214-1, and a concave groove 215 is also formed on an outside of the 1-2 joint rib 214-2-2.

The groove 215-1 is elongated from the 1-1 joint rib 214-1 in the longitudinal direction of the first vane 210. The groove 215-2 is elongated from the 1-2 joint rib 214-2 in the longitudinal direction of the first vane 210.

The groove 215-1 is located on an outside of the first joint part 216 of the 1-1 joint rib 214-1, and the groove 215-2 is located on an outside of the first joint part 216 of the 1-2 joint rib 214-1. The respective grooves 215-1 and 215-2 are disposed on the same line.

Interference between the first vane link 250 and the first vane body 212 may be avoided by the respective grooves 215-1 and 215-2.

An air guide 280 is disposed between the 1-1 joint rib 214-1 and the 1-2 joint rib 214-2. The air guide 280 is formed integrally with the first vane body 212. Unlike this embodiment, the air guide may be separately manufactured and assembled with the first vane body 212.

The air guide 280 is elongated along the longitudinal direction of the first vane body 212.

The air guide 280 includes: a first connection guide 281 disposed toward the 1-1 joint rib 214-1 and extending upward from the upper surface of the first vane body 212; a second connection guide 282 disposed toward the 1-2 joint rib 214-2 and extending upward from the upper surface of the first vane body 212; a main guide 285 connecting the first connection guide 281 and the second connection guide 282 and spaced apart from the upper surface of the first vane body 212; and a support guide 286 connecting the main guide 285 and the first vane body 212.

The air guide 280 is disposed between the 1-1 joint rib 214-1 and the 1-2 joint rib 214-2. The air guide 280 is located on a forward side of the first joint part 216.

The first connection guide 281 forms a curved surface to minimize air resistance. The first connection guide 281 forms a curved surface in the longitudinal direction of the first vane 210. The second connection guide 282 also forms a curved surface in the longitudinal direction of the first vane 210.

The first connection guide 281 and the second connection guide 282 are disposed to face each other.

The first connection guide 281 is disposed to face the 1-2 joint rib 214-2, and the second connection guide 282 is disposed to face the 1-1 joint rib 214-1.

The left side of the main guide 285 is connected to the first connection guide 281, and the right side of the main guide 285 is connected to the second connection guide 282. The main guide 285 is spaced apart from the upper surface of the first vane body 212. Discharged air may be guided between the main guide 285 and the upper surface of the first vane body 212.

A space between the main guide 285 and the first vane body 212 is defined as a guide space 283. The guide space 283 may be formed long along the longitudinal direction of the first vane body 212.

The support guide 286 divides the guide space 283 into the left side and the right side. The support guide 286 is provided in plurality, and the guide space 283 is divided into a plurality of spaces by the support guides 286.

The support guide 286 connects the upper surface of the first vane body 212 and a lower surface of the main guide 285. A plurality of support guides 286 are disposed to be spaced apart from each other by a predetermined distance along the longitudinal direction of the first vane body 210.

In this embodiment, seven support guides 286 are disposed, and as an odd number of the support guides is disposed, the same number of guide spaces 283 are formed on the left and right sides. With respect to the central support guide 286, the guide spaces on the left side and the guide spaces on the right side are symmetrical.

The support guide 286 is vertically disposed in the first vane body 212.

A rear end of the support guide 286 may form a long tail toward a rear side of the first vane 210 (in a direction opposite to a direction in which air is discharged). The tail is defined as a support guide tail. The support guide tail is disposed in a front-rear direction of the support guide 286 and is formed to decrease in height from an upper side of the support guide 286 toward the first vane body 212.

The rear end of the support guide tail is located more rearward than the rear edge 285*b* of the main guide 285.

A length from the support guide 286 to the support guide tail is longer than a length in the front-rear direction of the main guide 285.

A recess line 218 concave downward is formed in the upper surface of the first main body 212. The recess line 218 is provided in plurality.

The recess line 218 is formed along a front end 212*a* of the first vane of the first vane 210, and a plurality of recess lines form rows from the front end 212*a* of the first vane to the rear side. In this embodiment, the recess lines 218 are configured in three rows.

A first row of the recess lines 218 is located closest to the front end 212*a* of the first vane and has a longest length. A third row of the recess lines 218 is located farthest from the front end 212*a* of the first vane and has a shortest length. A length of a second row of the recess lines 218 is shorter than that of the first row and longer than that of the third row.

The three rows of the recess lines 218 are located on a forward side of the front edge 285*a* of the main guide 285.

The plurality of recess lines 218 may improve a flow of discharged air.

Meanwhile, referring to FIGS. 10 and 11, the second vane 220 of the vane module 200 according to an embodiment of the present disclosure is formed with an area smaller than that of the first vane 210. When controlling a discharge direction of air, the second vane 220 has a less influence than the first vane 210. In this embodiment, the first vane 210 is operated as a main vane for controlling the air discharge direction, and the second vane 220 is operated as a sub-vane.

The second vane 220 is installed in the discharge flow path and rotates in place about the second vane shaft 221. The front end 222*a* of the second vane 220 may be located outside the outlet 101 depending on an angle of rotation of the second vane 220.

In this embodiment, the second vane 220 is formed of a transparent or translucent material.

The second vane 220 includes: a second vane body 222 formed to be elongated in the longitudinal direction of the outlet 101; a joint rib 224 protruding upward from the second vane body 222 and rotatably coupled to the second vane link 260; and a pair of second vane shafts 221 respectively formed at one side and the other side of the second vane body 222 and rotatably coupled to the motor coupling part 430.

The second joint rib 224 is coupled to the second vane link 260 to be relatively rotatable, and the second joint rib 224 is formed by protruding upward from the upper surface of the second vane body 222. The second joint rib 224 is preferably formed along a flow direction of discharged air. Thus, the second joint rib 224 is disposed to be orthogonal to or cross a longitudinal direction of the second vane body 222.

The second vane shaft 221 includes a 2-1 vane shaft 222-1 and a 2-2 vane shaft 221-2. The 2-1 vane shaft 222-1 and the 2-2 vane shaft 221-2 are located on a straight line and protrude in directions opposite to each other.

The 2-1 vane shaft 222-1 protrudes in one direction (leftward), and the 2-2 vane shaft 221-2 protrudes in the other direction (rightward).

The second vane body 222 is formed to be elongated along the longitudinal direction of the outlet 101. The second vane body 222 includes: a second vane body part 223 formed to be elongated along the longitudinal direction of the outlet; a 2-1 vane shaft installation part 225-1 protruding from the second vane body part 223 in one direction (leftward) and having the 2-1 vane shaft 222-1 formed therein; a 2-2 vane shaft installation part 225-2 protruding from the second vane body part 223 in the other direction (rightward) and having the 2-2 vane shaft 221-2 formed therein; and a recess line 228 formed in an upper surface of the second vane body part 223 and formed concave downward in the upper surface of the second vane body 223.

The second vane body part 223 may be formed in various shapes. In a top view, the second vane body part 223 is close to a rectangular shape.

The recess line 228 is formed in the upper surface of the second vane body part 223. The recess line 228 is configured in plurality. A length of the recess line 228 is longer in a direction to the front end 222*a* of the second vane 220, and shorter in a direction to the rear end 222*b* of the second vane 220.

The joint rib 224 has a structure capable of shaft-coupling or hinge-coupling, and may be deformed in various forms. A hole formed in the second joint rib 224 and coupled to the second vane link 220 to be relatively rotatable is defined as a third joint part 226.

In this embodiment, the third joint part 226 is formed in the shape of a hole and passes through the joint rib 224. The third joint part 226 has a structure capable of shaft coupling or hinge coupling, and is deformable in various forms.

When it is necessary to distinguish the joint rib 214 of the first vane 210 and the joint rib 224 of the second vane 220, a joint of the first vane 210 is defined as a first joint rib 214 and a joint of the second vane 220 is defined as a second joint rib 224.

The second vane 220 may be relatively rotatable relatively about the second joint rib 224, and may also be relatively rotatable about the second vane shaft 221. That is, the second vane 220 may be relatively rotatable at each of the second joint rib 224 and the second vane shaft 221.

In a top view, the second joint rib 224 is located on a forward side of the second vane shaft 221. The second joint rib 224 moves in a constant orbit about the second vane shaft 221.

Two second joint ribs 224 are disposed at the second vane 220. When it is necessary to distinguish the two second joint ribs 224 disposed at the second vane 220, a joint rib 224 disposed on the left side of the vane module 200 when viewed from the front is defined as a 1-1 joint rib 224-1, and a joint rib 224 disposed on the right side of the vane module 200 is defined as a 1-2 joint rib 224-2.

A third joint part 226 is disposed at each of the 1-1 joint rib 224-1 and the 1-2 joint rib 224-2.

The second vane body part 223 is disposed between the 1-1 joint rib 224-1 and the 1-2 joint rib 224-2.

A left edge 223*a* of the second vane body part 223 is located outside the left joint part 224-1. A right edge 223*b* of the second vane body part 223 is located outside the right joint part 224-2.

The left edge 223*a* of the second vane body 223 is disposed between the left joint part 214-1 of the first vane 210 and the left joint part 224-1 of the second vane 220. The right edge 223*b* of the second vane body 223 is disposed between the right joint part 214-2 of the first vane 210 and the right joint part 224-2 of the second vane 220.

The left joint part 224-1 and the right joint part 224-2 of the second vane 220 are disposed in parallel.

A bottom surface of the second vane body 222 may be formed in a gently curved surface.

The second vane body 222 controls a direction of air discharged along the discharge flow path 104. The discharged air collides with the upper or lower surface of the second vane body 222, so that a flow direction may be guided. The discharged air interacts with the recess line 228, thereby improving the flow of the air.

The flow direction of the discharged air and the longitudinal direction of the second vane body 222 are orthogonal to or cross each other. The flow direction of the discharged air and the longitudinal direction of the main recess 228-3 may be orthogonal to or cross each other.

The second vane body part 223 is located between the 1-1 joint rib 214-1 and the 1-2 joint rib 214-2 of the first vane 210. This is a structure for preventing interference when the second vane 220 is positioned above the first vane 210.

The 2-1 vane shaft installation part 225-1 protrudes in one direction (leftward) from the second vane body part 223. The 2-2 vane shaft installation part 225-2 protrudes in the other direction (rightward) from the second vane body part 223. The 2-1 vane shaft installation part 225-1 and the 2-2 vane shaft installation part 225-2 are arranged in a line and protrude in directions opposite to each other.

The 2-1 vane shaft 222-1 is disposed at the 2-1 vane shaft installation part 225-1, and the 2-2 vane shaft 222-1 is disposed at the 2-2 vane shaft installation part 225-2.

In this embodiment, a first vane shaft support part 227-1 is disposed between the 2-1 vane shaft installation part 225-1 and the 2-1 vane shaft 221-1, and a second vane shaft support part 227-2 is disposed between the 2-2 vane shaft installation part 225-2 and the 2-2 vane shaft 221-2.

The first vane shaft support part 227-1 restricts an insertion depth of the 2-1 vane shaft 222-1 when the 2-1 vane shaft 222-1 and the drive link coupling hole 407 are assembled. The second vane shaft support part 227-2 restricts an insertion depth of the 2-2 vane shaft 221-2 when the 2-2 vane shaft 221-2 and the second vane coupling part 409 are assembled.

The first vane shaft support part 227-1 is orthogonal to a protruding direction of the 2-1 vane shaft 221-1, and the second vane shaft support part 227-2 is orthogonal to a protruding direction of the 2-2 vane shaft 221-2.

A protrusion may be formed in the first vane shaft support part 227-1. The protrusion may reduce friction with the second vane coupling part 409 and may support the drive link coupling hole 407.

The second vane shaft 221 is located on a rearward side of the second joint rib 224.

The second vane link 260 and the motor coupling part 430 are sequentially disposed on a forward side of the second vane shaft 221.

Hereinafter, a coupling structure of the vane module will be described in detail with reference to FIGS. 12 to 15.

Figure 12:
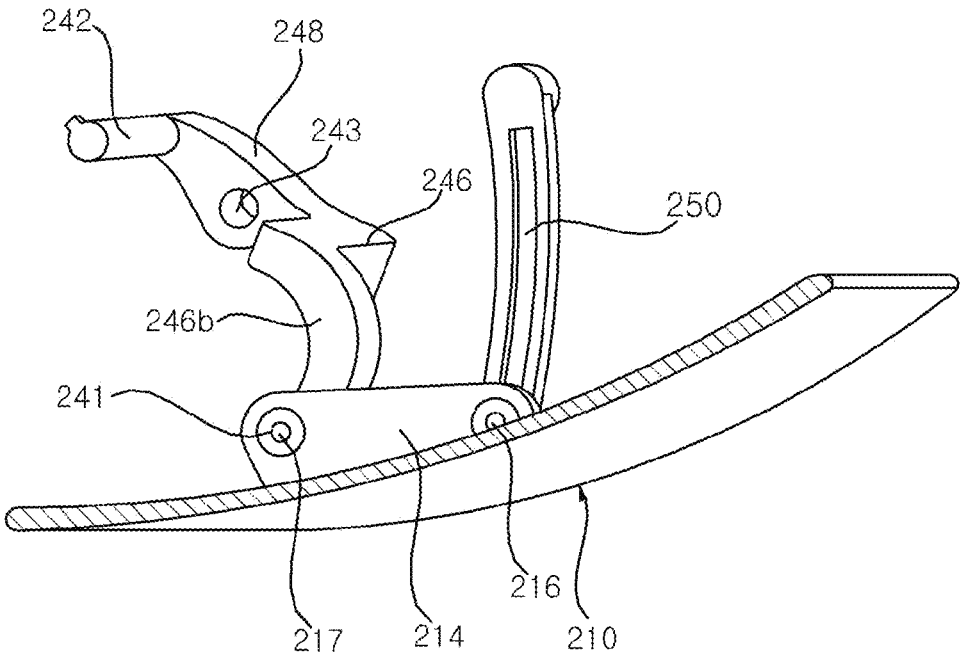
FIG. 12 is a diagram illustrating coupling of the first vane, the first vane link, and the drive link of FIG. 3.
Figure 13:
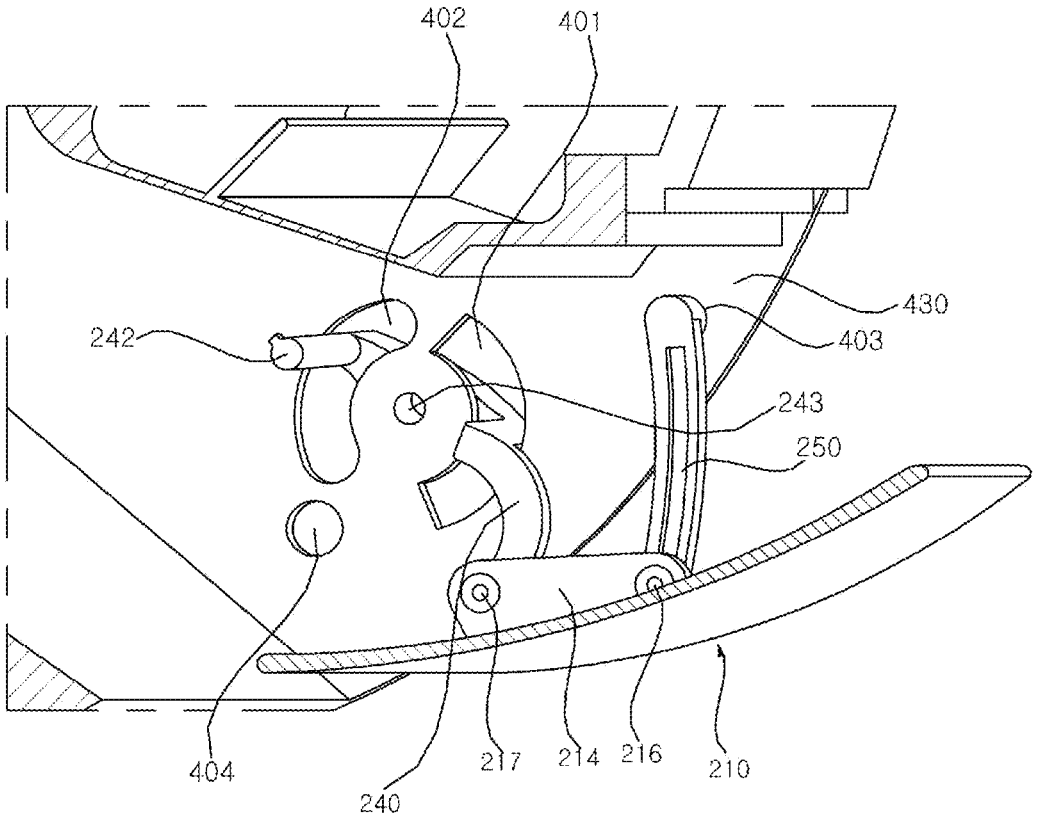
FIG. 13 is a perspective view illustrating a state in which a coupling body of FIG. 12 is coupled to the module body.
Figure 14:
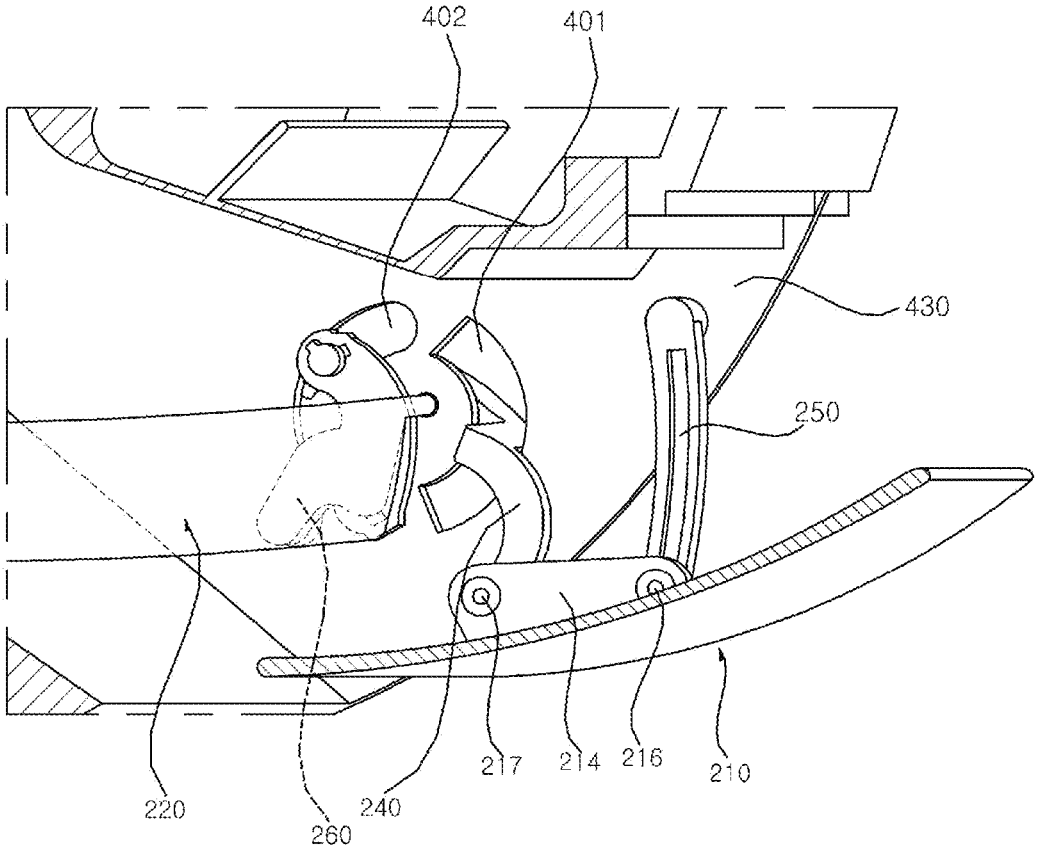
FIG. 14 is a perspective view illustrating a state in which the second vane, the second vane link, and the drive link are coupled to the module body.

FIG. 12 is a view showing a coupled state of the first vane, the first vane link, and the drive link of FIG. 3, FIG. 13 is a perspective view showing a state in which a coupling body of FIG. 12 is coupled to the module body, and FIG. 14 is a perspective view showing a state in which the second vane, the second vane link, and the drive link are coupled to the module body.

As shown in FIG. 12, in each joint rib 214 of the first vane 210, the second joint part 217 is rotatably coupled to the drive link 240, and the first joint part 216 is rotatably coupled to the first vane link 250.

That is, the first drive link shaft 241 is assembled with the second joint part 217. The second joint part 217 and the first drive link shaft 241 are assembled to be relatively rotatable. In this embodiment, the first drive link shaft 241 passes through the second joint part 217 and is assembled. The first joint part 216 is assembled with the 1-1 vane link shaft 251. The first joint part 216 and the 1-1 vane link shaft 251 are assembled to be relatively rotatable. In this embodiment, the 1-1 vane link shaft 251 passes through the first joint part 216 and is assembled therewith.

Prior to such a coupled structure, as shown in FIG. 13, in the drive link 240, the drive link body 247 is disposed at a rear surface of the motor coupling part 430 in which the vane motor 230 is formed, and the core link shaft 243 protrudes from the core body 248 toward the vane motor 230.

The core link shaft 243 is aligned with the drive link coupling hole 407 formed in the motor coupling part 430, and the core link shaft 243 may be relatively rotatable in a state of being aligned with the drive link coupling hole 407.

In order to protrude in a direction opposite to the core link shaft 243, that is, toward a front surface where the first vane 210 and the second vane 220 are disposed, the first drive link shaft 241 and the second drive link shaft 242 passes through the first and second guide holes 401 and 402 and is formed in the front surface.

Accordingly, the core body 248 of the drive link 240 is disposed on the outside (a vane motor side) of the motor coupling part 430, and only the core link shaft 243 of the drive link 240 is disposed on the outside (a vane motor side) of the motor coupling part 430. The first drive link body 246 and the second drive link body 247 pass through the motor coupling part 430 and are disposed inside of the motor coupling part 430 (a vane side).

The motor shaft 231 of the vane motor 230 is inserted into a hollow formed inside the core link shaft 243.

The core link shaft 243 is aligned with the drive link coupling hole 407.

Meanwhile, as shown in FIG. 14, the core link shaft 243 and the drive link coupling hole 407 are simultaneously penetrated by the second vane shaft 221, the 2-1 vane link hole 261 is assembled with the second vane 220, and the 2-2 vane link hole 262 is assembled with the second drive link shaft 242.

Meanwhile, the second drive link shaft 263 is assembled with the second vane link installation hole 404 of the motor coupling portion 430 to be rotatable.

Due to this coupling, the first vane 210 and the second vane 220 are inclined in various modes by driving of the vane motor 230, thereby enabled to adjust a flow rate and a flow direction.

In a state in which a suction grill 320 is assembled with a front body 310, at least one of the first vane 210 and the second vane 220 of the vane module 200 may be exposed.

When the indoor unit is not in operation, only the first vane 210 is exposed to a user. When the indoor unit is in operation and air is discharged, the second vane 220 may be selectively exposed to the user.

Figure 15A:
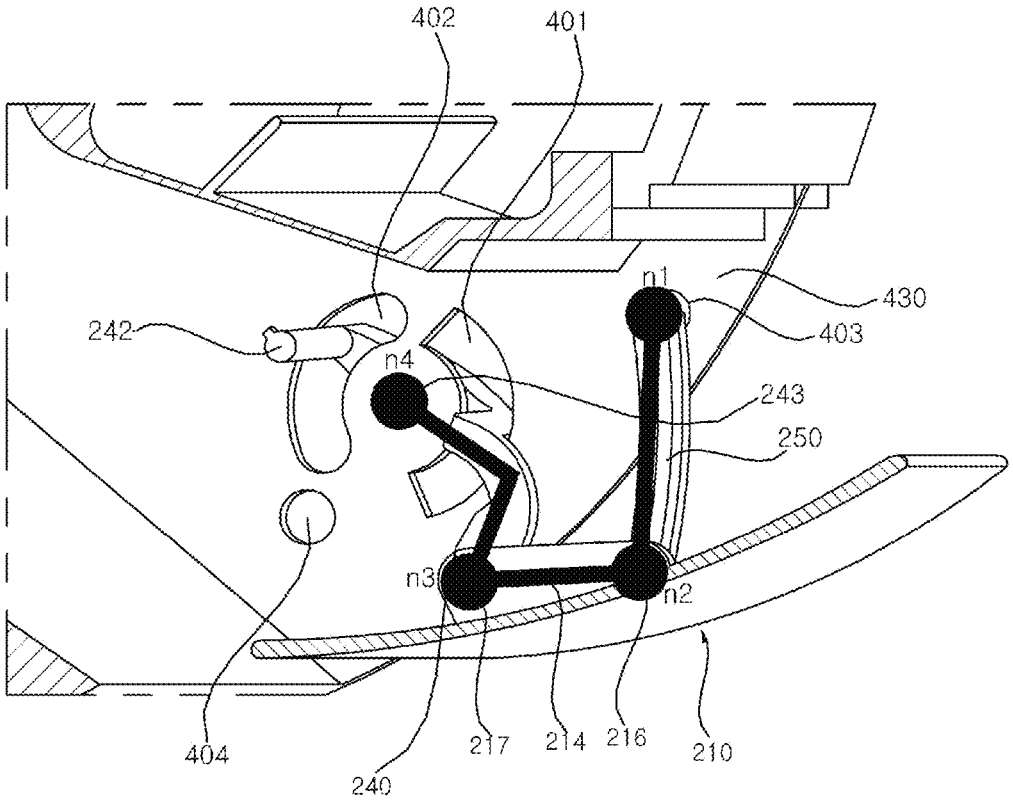
FIGS. 15A and 15B are state diagrams illustrating diffraction ranges of the first and second vanes.
Figure 15B:
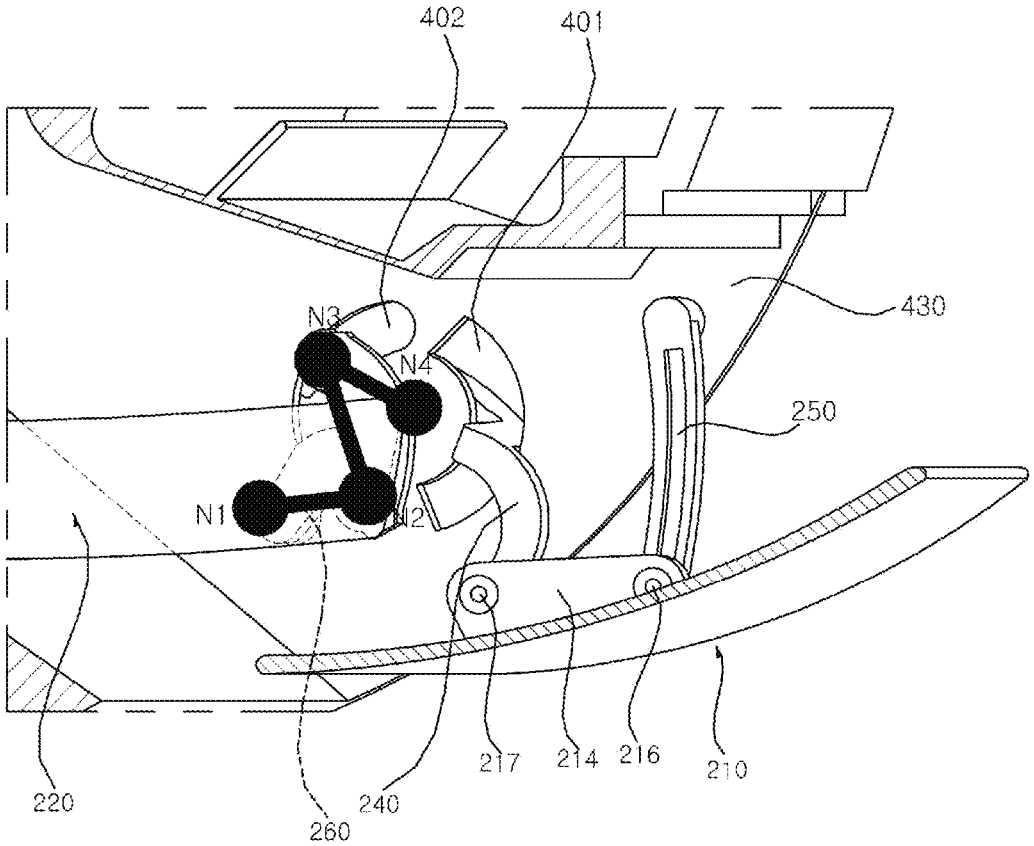
Figure 16:
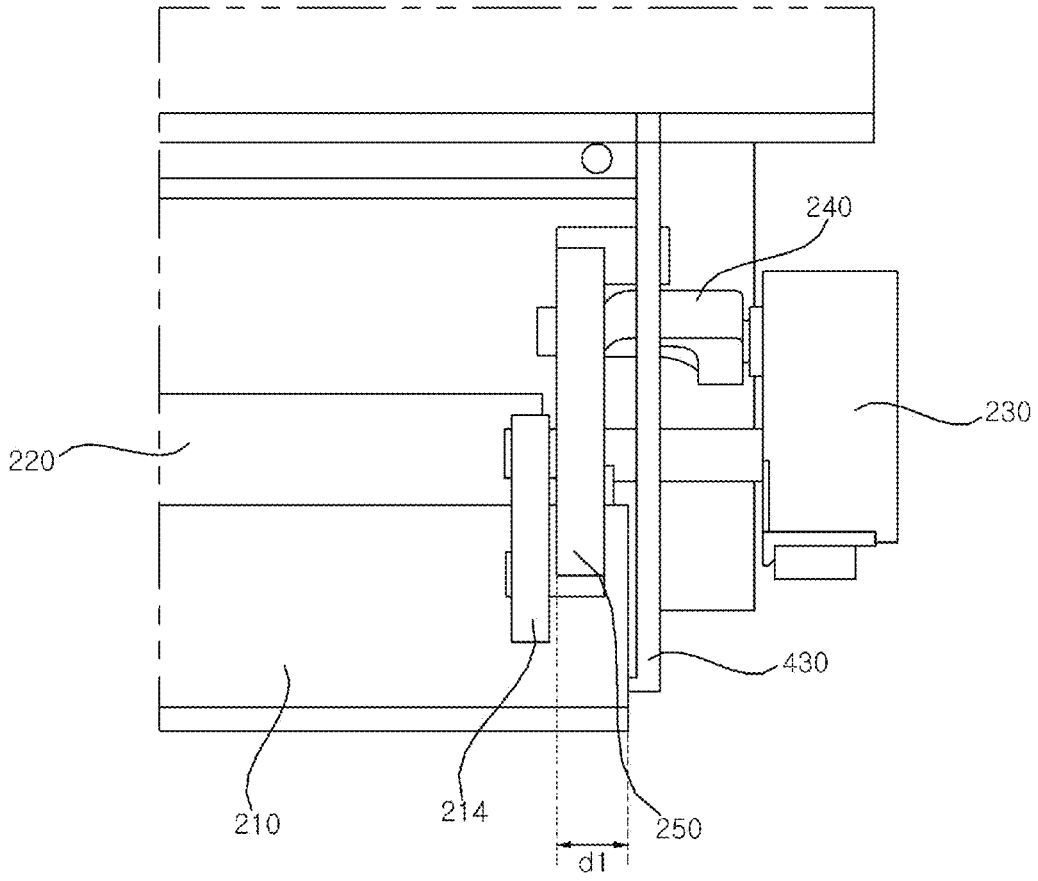
FIG. 16 is a front view of the vane module of FIG. 12 showing effects according to an embodiment of the present disclosure.

FIGS. 15A and 15B are state diagrams showing a range of rotation of the first and second vanes, and FIG. 16 is a front view of the vane module of FIG. 12, which shows effects according to an embodiment of the present disclosure.

Such a vane module 200 may implement a four-bar link having four inflection points for direction change of the first vane 210 as shown in FIG. 15A.

That is, a first inflection point n1 is implemented by coupling between the motor coupling part 430 and one end of the first vane link 250, a second inflection point n2 is implemented by coupling between the other end of the first vane link 250 and one shaft of the first vane 210, a third inflection point n3 is implemented by coupling between the other shaft of the first vane 210 and the drive link 240, and a fourth inflection point n4 is implemented by coupling between the drive link 240 and the vane motor 230.

Meanwhile, referring to FIG. 15B, the second vane 220 may also implement a four-bar link having four inflection points for direction change.

That is, a first inflection point N1 is implemented by coupling between the motor coupling part 430 and one end of the second vane link 260, a second inflection point N2 is implemented by coupling between the other end of the second vane link 260 and one shaft of the second vane 220, a third inflection point N3 is implemented by coupling between the second vane link 260 and the drive link 240, and a fourth inflection point N4 is implemented by coupling between the other shaft of the second vane 220 and the vane motor 230.

In the four-bar structure of each of these dual vanes, when viewed from the front as in FIG. 16, the first vane link 250 and the second vane link 260 passing through the plurality of holes 401, 402, 407, 408, and 404 of the motor coupling part 430 corresponding to a case and coupled to the drive link 240 are arranged in a line on the same plane of the front surface of the motor coupling part 430, and thus, the effect that a thickness of the vane module for link coupling is very narrow is derived.

Accordingly, an area occupied by the first and second vanes 210 and 220 increases, and an maximum value of the flow rate increases to thereby increase a maximum flow rate.

Hereinafter, a vane module according to another embodiment of the present disclosure will be described with reference to FIGS. 17 to 22B.

Figure 17:
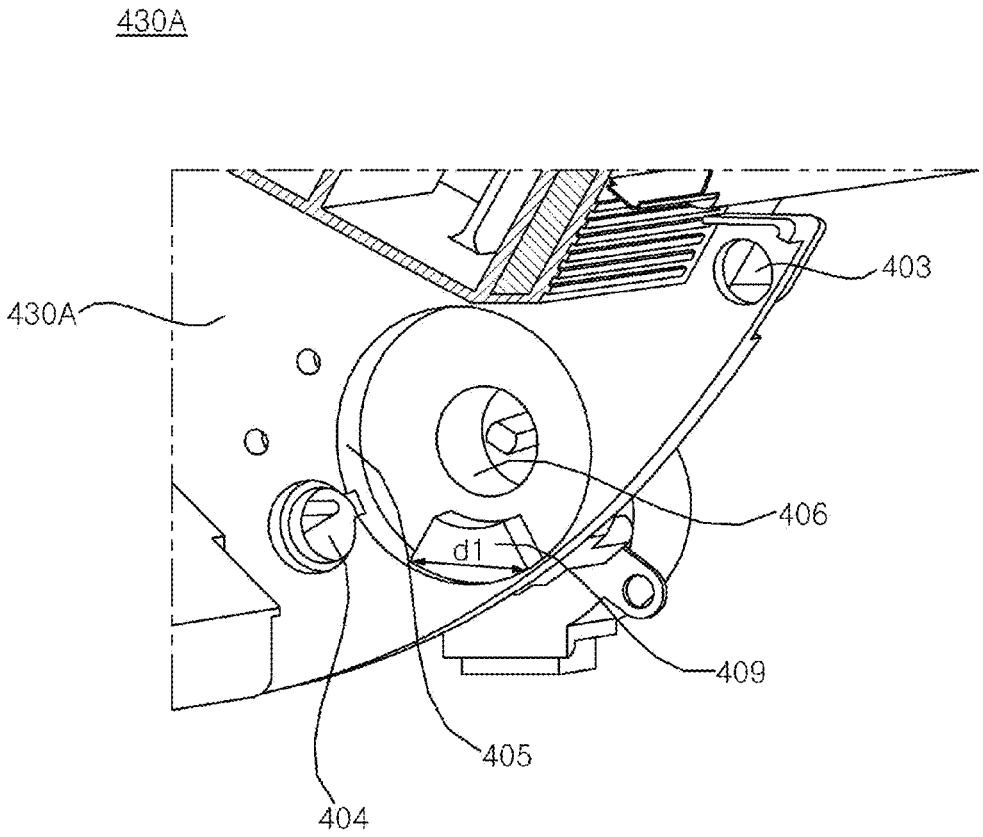
FIG. 17 is a perspective view of a module body of a vane module according to another embodiment of the present disclosure.
Figure 18:
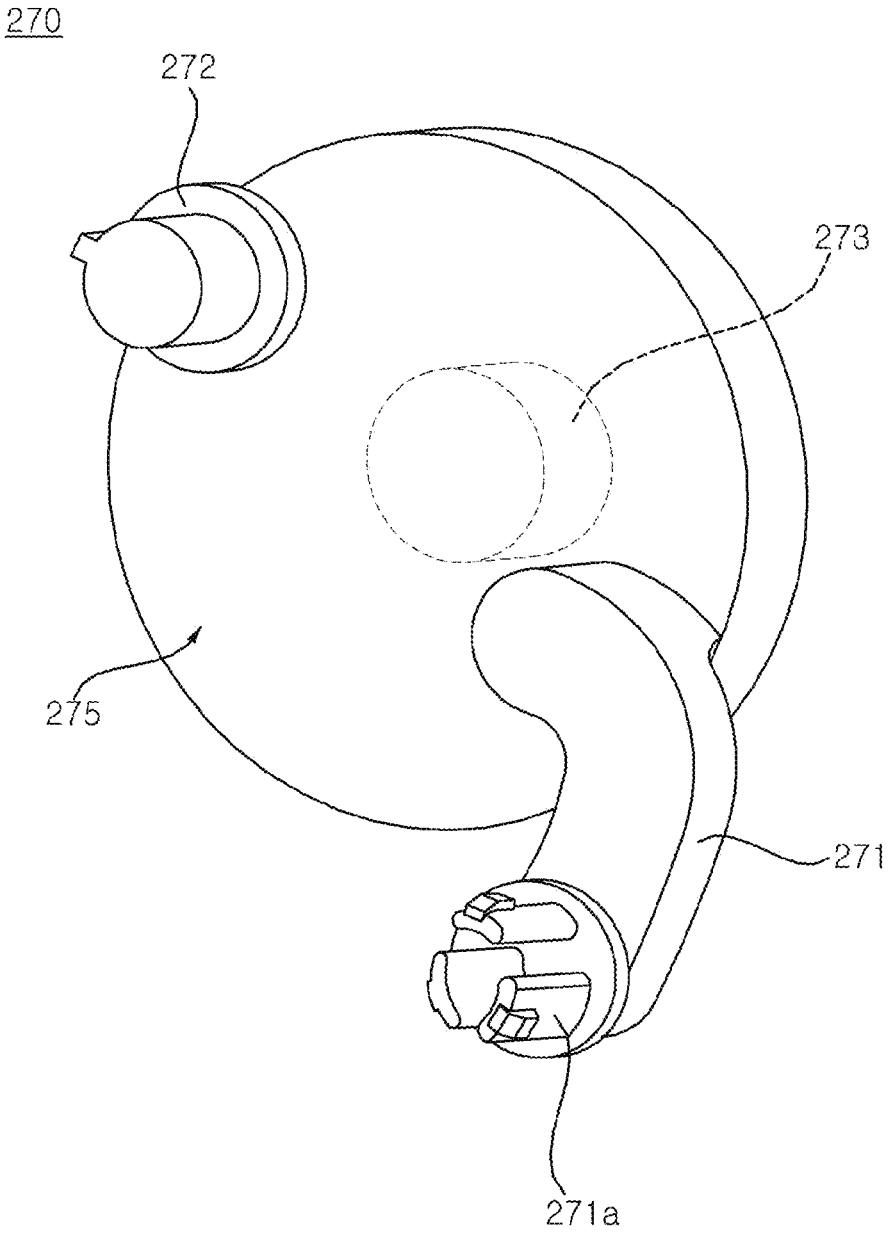
FIG. 18 is a perspective view of a drive link of the vane module applied to FIG. 17.
Figure 19:
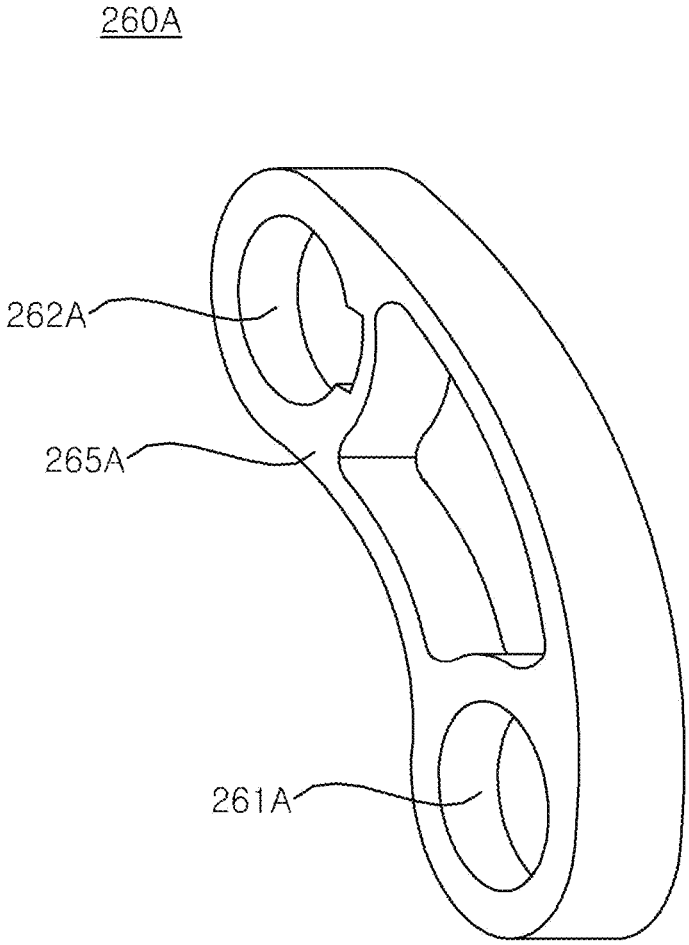
FIG. 19 is a perspective view of a second vane link of the vane module of FIG. 17.
Figure 20:
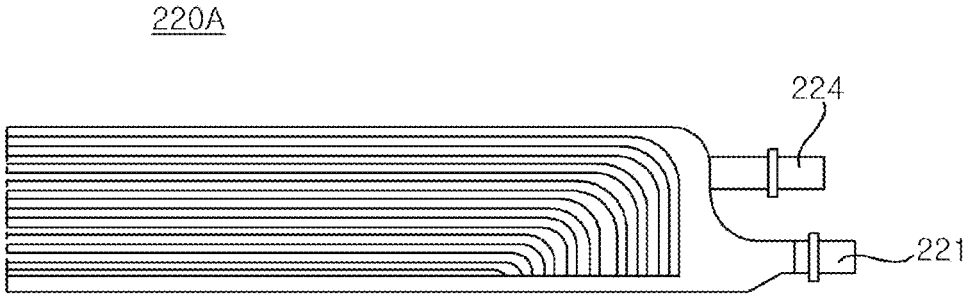
FIG. 20 is a perspective view of a second vane applied to FIG. 17.

FIG. 17 is a perspective view of a module body of a vane module according to another embodiment of the present disclosure, FIG. 18 is a perspective view of a drive link of the vane module applied to FIG. 17, and FIG. 19 is a perspective view of a second vane link of the vane module of FIG. 17.

The vane module according to another embodiment of the present disclosure has a configuration similar to that of the above-described embodiment of the present disclosure.

Therefore, a description of the first vane link 250 and the first vane 210 having the same configuration will be omitted and other parts will be described.

A motor coupling portion 430A is disposed at a side surface toward the first vane 210 and the second vane 220 out of side surfaces of a module body part 440.

The motor coupling part 430A is assembled with the drive link 270, the first vane link 250, the second vane link 260, and the second vane 220, and provides a center of rotation to each of the drive link 270, the first vane link 250, the second vane link 260, and the second vane 220.

In this embodiment, in order to minimize vibration or noise caused by the first vane 210, the second vane 220, the vane motor 230, the drive link 240, the first vane link 250, and the second vane link 260, and the like, an opening hole of the motor coupling part 430A is minimized.

The vane motor 230 is disposed outside a motor coupling part 430A of the first module body 410 or outside a motor coupling part 430A of the second module body 420.

The first vane 210, the second vane 220, the drive link 270, the first vane link 250, and the second vane link 260 are coupled between the first module body 410 and the second module body 420, thereby integrating the vane module 200 into one body.

Referring to FIG. 17, in the vane module 200 according to another embodiment of the present disclosure, the motor coupling part 430A, which is a side surface of the module body, is disposed to face the first vane 210 and the second vane 220, and a plurality of openings and opening grooves 405 for coupling the drive link 270, the first vane link 250, and the second vane link 260 are formed in each motor coupling part 430A.

Specifically, the motor coupling part 430A has the following formed therein: a drive link coupling hole 406 assembled with a disk-type drive link 270 and providing a center of rotation to the drive link 270; a first vane link coupling hole 403 assembled with the first vane link 250 and providing a center of rotation to the first vane link 250; and a second vane coupling hole 404 coupled to the second vane 220 and providing a center of rotation to the second vane 220 are formed in the motor coupling part 430A.

In addition, a guide groove 405 having a step along a circumference of a circle surrounding the drive link coupling hole 406 based on the drive link coupling hole 406 and provided for insertion of the drive link 270 itself is included.

In this embodiment, the drive link coupling hole 406, the first vane link coupling hole 408, and the second vane coupling hole 404 are each formed in the shape of a hole passing through the motor coupling part 430A.

The motor shaft of the vane motor 230 and the shaft of the second vane 220 are coupled in the drive link coupling hole 406.

The second vane shaft 221 of the second vane 220 is inserted into the second vane coupling hole 404.

One end of the first vane link 250 is inserted into the first vane link coupling hole 408 and is rotatably coupled thereto.

Regarding the drive link coupling hole 406, the first vane link coupling hole 408, and the second vane coupling hole 404, the drive link coupling hole 407 is disposed in a central area of the motor coupling part 430A, the first vane link coupling hole 408 is disposed in an upper right side of the drive link coupling hole 406, and the second vane coupling hole 404 is disposed in a lower left side of the drive link coupling hole 406.

The sizes of the drive link coupling hole 406, the first vane link coupling hole 408, and the second vane coupling hole 404 may be different from each other, but may be determined according to the sizes of coupling shafts of the respective links. For example, when the sizes of the coupling shafts of the respective links are the same, the diameters of the respective coupling holes may be the same.

Meanwhile, the guide groove 405 is formed in the motor coupling part 430A with the drive link coupling hole 406 as a center.

The guide groove 405 is defined as a disk-shaped groove having a predetermined distance from the drive link coupling hole 406 as a center, as described above. The predetermined distance corresponds to a radius of the drive link 270 to accommodate the drive link 270.

The guide groove 405 forms a path in which each coupling shaft of the drive link 270 is installed and moved while rotating.

The vane motor 230 is assembled with the outside of the motor coupling part 430A. The rotational shaft of the vane motor 230 is rotatably coupled to a central axis of the drive link 270.

As such, since a coupling body capable of being directly and rotatably coupled to each link and each vane is formed in the shape of holes and grooves in the motor coupling part 430A, which is one surface of the module body 410, a coupling thickness as large as a thickness of the case of the motor coupling part 430A is required and the thickness is not increased by protrusion required for link coupling, and thus, the size of the module is minimized.

Accordingly, the thickness of the drive link 270 protruding toward an air passage is significantly reduced, so the discharged air and the drive link 270 come into contact with each other, thereby preventing a decrease in a flow force of the air and also preventing dew condensation in a corresponding contact area, the dew condensation which may cause damage to equipment damage. Specifically, referring to FIG. 18, the drive link 270 is directly connected to the vane motor 230. A motor shaft (not shown) of the vane motor 230 is directly coupled to the drive link 270, and an amount of rotation of the drive link 270 is determined by an angle of rotation of a rotational shaft of the vane motor 230.

The drive link 270 is seated in and coupled to the guide groove 405 formed in the front surface of the motor coupling part 430A, is assembled with the second vane link 260 and the first vane 210 at the front surface of the motor coupling part 430A, and is assembled with the vane motor 230 at the rear surface of the motor coupling part 430A.

The drive link 270 includes: a drive link body 275; a first drive link shaft 271 disposed at the drive link body 275 and rotatably coupled to the first vane 210; a core link shaft 273 disposed at the drive link body 275, aligned with the drive link coupling hole 406 of the motor coupling part 430A and rotatably coupled by the second vane 220; a second drive link shaft 272 disposed at the drive link body 275 and rotatably coupled to the second vane link 260.

The drive link body 275 has the core link shaft 273 disposed therein, and has a shape corresponding to the shape of the guide groove 405, so that the drive link body 275 is inserted into the guide groove 405 and rotatably coupled thereto.

The core link shaft 273 protrudes from the drive link body 275 toward the vane motor 230.

The core link shaft 273 is rotatably assembled with the motor coupling part 430A. The core link shaft 273 is aligned with the drive link coupling hole 406 formed in the motor coupling part 430A. The core link shaft 273 may be relatively rotatable while aligned with the drive link coupling hole 407.

The first drive link shaft 271 and the second drive link shaft 272 protrude in a direction opposite to the core link shaft 273, that is, toward the front surface where the first vane 210 and the second vane 220 are disposed.

The core link shaft 273 is formed in a cylindrical shape which is empty inside. The motor shaft 231 of the vane motor 230 is inserted into a hollow formed in the core link shaft 273.

The first drive link shaft 271 is a shaft rotation structure for rotation with the first vane 210.

The first drive link shaft 271 may be formed at one end of a protruding area that protrudes from one point of the drive link body 275 and extends downward.

Such a protruding area corresponds to the first drive link shaft installation part 276-1 of FIG. 8, and the first drive link shaft 271 rotatably assembled with the first vane 210 is formed at the one end.

Since the structure of the first drive link shaft 271 is the same as that of the above-described embodiment, a detailed description thereof is omitted.

Meanwhile, in the drive link body 275, the second drive link shaft 272 is formed in an area opposite to the first drive link shaft 271.

The second drive link shaft 272 is formed in a cylindrical shape. The second drive link shaft 272 protrudes in a direction opposite to the core link shaft 273 and forms mutual engagement with the second vane link 260.

The first drive link shaft 271 and the second drive link shaft 272 provide a structure in which the drive link body 275 and the first vane 210 and the second vane 220 are relatively rotatable. In this embodiment, the first drive link shaft 271 and the second drive link shaft 272 are formed integrally with the drive link body 275.

In this case, since the first vane link coupled to the drive link 270 has the same structure as that of the first vane link 250 according to an embodiment of the present disclosure described with reference to FIG. 6, a detailed description thereof will be omitted.

Referring to FIG. 19, the second vane link 260A of the vane module according to another embodiment of the present disclosure is made of a solid material and is elongated in a curved shape.

The second vane link 260A includes: a second vane link body 265A; a 2-1 vane link hole 261 disposed at one end in a longitudinal direction of the second vane link body 265, assembled with the second vane 220, and relatively rotatable with the second vane 220; and a 2-2 vane link hole 262A disposed at the other end in the longitudinal direction of the second vane link body 265, assembled with the drive link 270, specifically the second drive link shaft 272, and relatively rotatable with the drive link 270.

In this embodiment, the 2-1 vane link hole 261A and the 2-2 vane link hole 262A are each formed in the shape of a hole passing through the second vane link body 265A. The 2-2 vane link hole 262A and the second drive link shaft 272 are assembled with each other to provide a relatively rotatable shaft rotation structure.

When any one of the 2-2 vane link hole 262A and the second drive link shaft 272 is formed in the shape of a shaft, the other may be formed in the shape of a hole or a boss providing a center of rotation.

Such substitution of configuration is possible for all components coupled with drive link 270, the first vane link 250, and the second vane link 260A and capable of being rotatable relatively, and an example of variation thereof will not be additionally described in detail.

The 2-1 vane link hole 261A may be assembled with the second vane 220 and may be relatively rotatable with the second vane 220.

The 2-1 vane link hole 261A is a shaft rotation structure for relative rotation with the second vane 220. The 2-1 vane link hole 261A is formed in a cylindrical structure. A link shaft engaging part (not shown) may be formed in an outer circumferential surface of the 2-1 vane link hole 261A. The link shaft engaging part forms mutual engagement with the second vane 220.

In this embodiment, the 2-2 vane link hole 262A is formed in the shape of a hole passing through the second vane link body 265A. When the second drive link shaft 272 of the drive link 270 is rotated after passing through the 2-2 vane link hole 262A, the second vane link 260A and the second drive link shaft 272 are assembled and prevented from being separated in the insertion direction of the second drive link shaft 272. The second drive link shaft 272 may be relatively rotatable in a state of being assembled with the 2-2 vane link hole 262A.

Since the first vane 210 and the second vane 220 of the vane module 200 according to another embodiment of the present disclosure are the same as described above, a detailed description thereof will be omitted.

However, the second vane 220A includes: a second vane body 222 formed to be elongated in the longitudinal direction of the outlet 101; a joint rib 224 protruding upward from the second vane body 222 and rotatably coupled to the motor coupling part 430A; a pair of second vane shafts 221 respectively formed in one side and the other side of the second vane body 222 and rotatably coupled to the second vane link 260A.

The second joint rib 224 is rotatably coupled to the motor coupling part 430A, and the second joint rib 224 is formed by protruding upward from the upper surface of the second vane body 222.

The second vane 220 may be relatively rotatable relatively about the second joint rib 224, and may also be relatively rotatable about the second vane shaft 221. That is, the second vane 220 may be relatively rotatable at each of the second joint rib 224 and the second vane shaft 221.

The second joint rib 224 is located on a forward side of the second vane shaft 221. The second joint rib 224 moves in a constant orbit about the second vane shaft 221.

The second vane shaft 221 may be rotatably assembled with the 2-1 vane link hole 261A of the second vane link 260A.

Hereinafter, a coupling structure of the vane module will be described with reference to FIGS. 21 to 22B.

Figure 21:
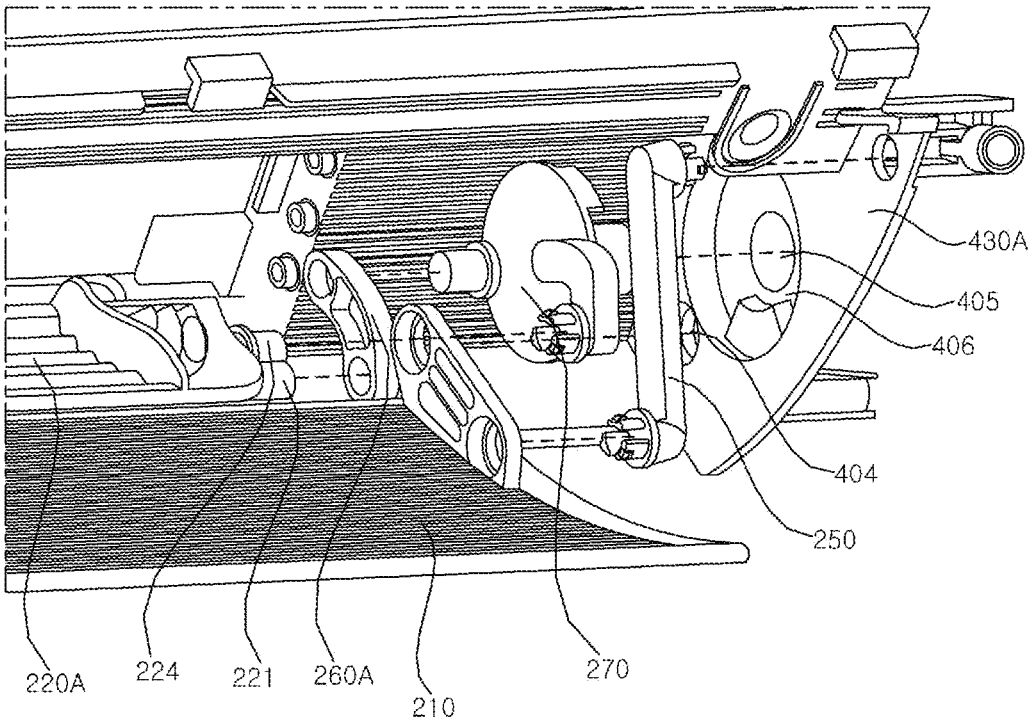
FIG. 21 is an exploded perspective view of the vane module according to another embodiment of the present disclosure of FIG. 17.
Figure 22A:
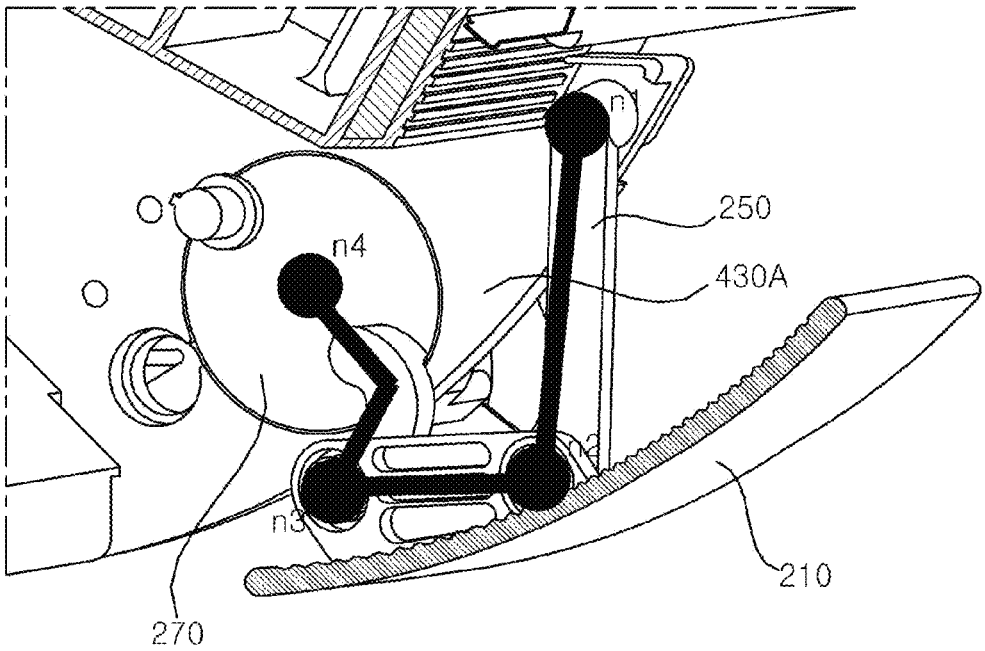
FIGS. 22A and 22B are state diagrams illustrating diffraction ranges of the first and second vanes.
Figure 22B:
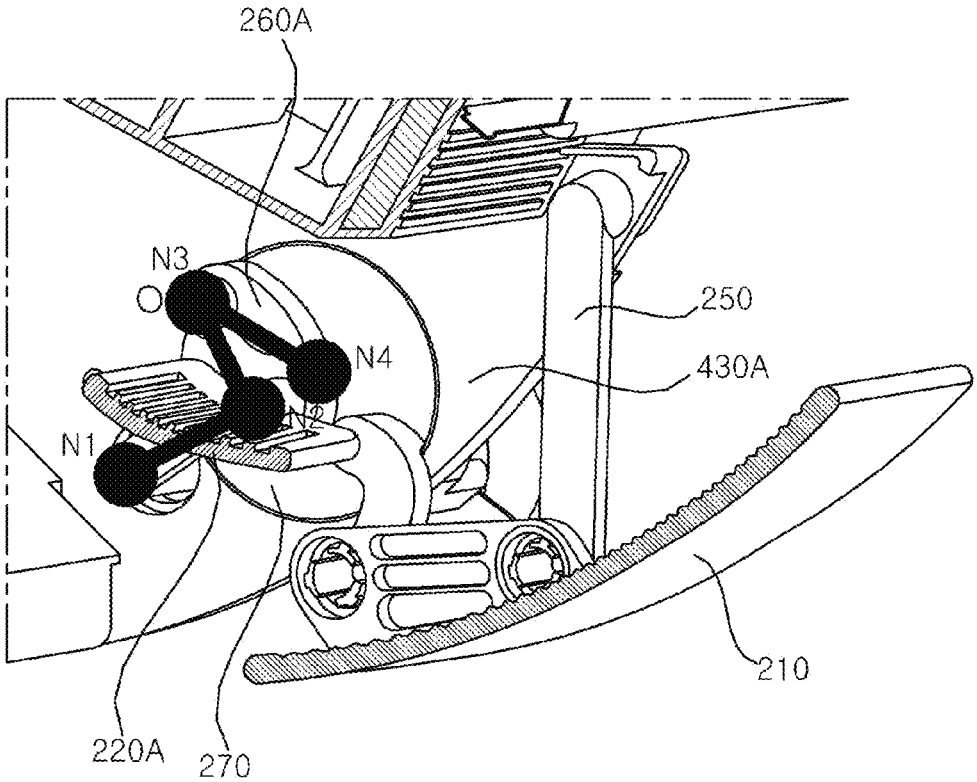

FIG. 21 is an exploded perspective view of the vane module according to another embodiment of the present disclosure of FIG. 17, and FIGS. 22A and 22B are state diagrams illustrating diffraction ranges of the first and second vanes.

Referring to FIG. 21, the drive link 270 is inserted in and rotatably coupled to the guide groove 405 of the motor coupling part 430A.

In each joint rib 214 of the first vane 210, the second joint part 217 is rotatably coupled to the drive link 270, and the first joint part 216 is rotatably coupled to the first vane link 250.

That is, the first drive link shaft 271 is assembled with the second joint part 217. The second joint part 217 and the first drive link shaft 271 are assembled to be relatively rotatable. The first joint part 216 is assembled with the 1-1 vane link shaft 251. The first joint part 216 and the 1-1 vane link shaft 251 are assembled to be relatively rotatable.

In such a coupling structure, in the drive link 240, the motor shaft 231 of the vane motor 230 is inserted into a hollow formed inside the core link shaft 243.

The first drive link shaft 271 and the second drive link shaft 272 are exposed in a state of protruding in a direction opposite to the core link shaft 243, that is, toward the front surface where the first vane 210 and the second vane 220 are disposed.

Due to this coupling, the first vane 210 and the second vane 220 are inclined in various modes by driving of the vane motor 230, thereby enabled to adjust a flow rate and a flow direction.

FIGS. 22A and 22B are state diagrams illustrating diffraction ranges of the first and second vanes.

Such a vane module 200 may implement a four-bar link having four inflection points for direction change of the first vane 210 as shown in FIG. 22A.

That is, a first inflection point n1 is implemented by coupling between the motor coupling part 430A and one end of the first vane link 270, a second inflection point n2 is implemented by coupling between the other end of the first vane link 250 and one shaft of the first vane 210, a third inflection point n3 is implemented by coupling between the other shaft of the first vane 210 and the drive link 270, and a fourth inflection point is implemented by coupling between the drive link 270 and the vane motor 230.

Meanwhile, referring to FIG. 22B, the second vane 220A may also implement a four-bar link having four inflection points for direction change.

That is, a first inflection point N1 is implemented by coupling between the motor coupling part 430A and the joint rib of the second vane 220A, a second inflection point N2 is implemented by coupling between the second vane shaft 221 of the second vane 220A and the other end of the second vane link 260A, a third inflection point N3 is implemented by coupling between the second vane link 260A and the drive link 270, a fourth inflection point N4 is implemented by coupling between the drive link 270 and the vane motor 230.

In the four-bar structure of each of these dual vanes, when viewed from the front as in FIG. 16, a thickness may be further reduced by forming a guide groove 406 into which the drive link 270 is allowed to be inserted in the motor coupling part 430A corresponding to a case, and since a hole for the guide is not exposed, it is possible to prevent a flow loss, vibration, and noise that may occur due to air being discharged to the outside.

Hereinafter, a drive link of a vane module according to yet another embodiment of the present disclosure will be described with reference to FIGS. 23 to 27.

Figure 23:
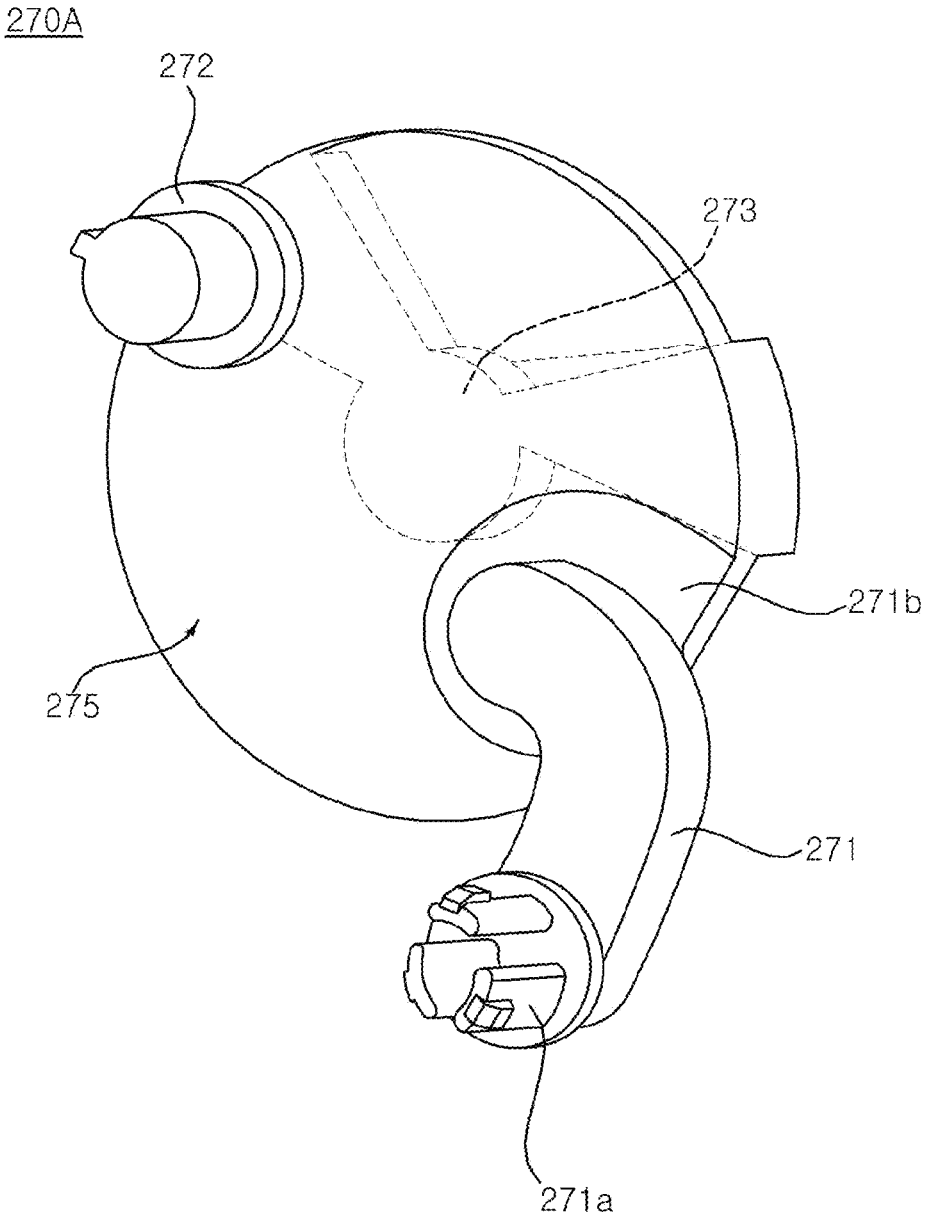
FIG. 23 is a front perspective view of a drive link of a vane module according to yet another embodiment of the present disclosure.
Figure 24:
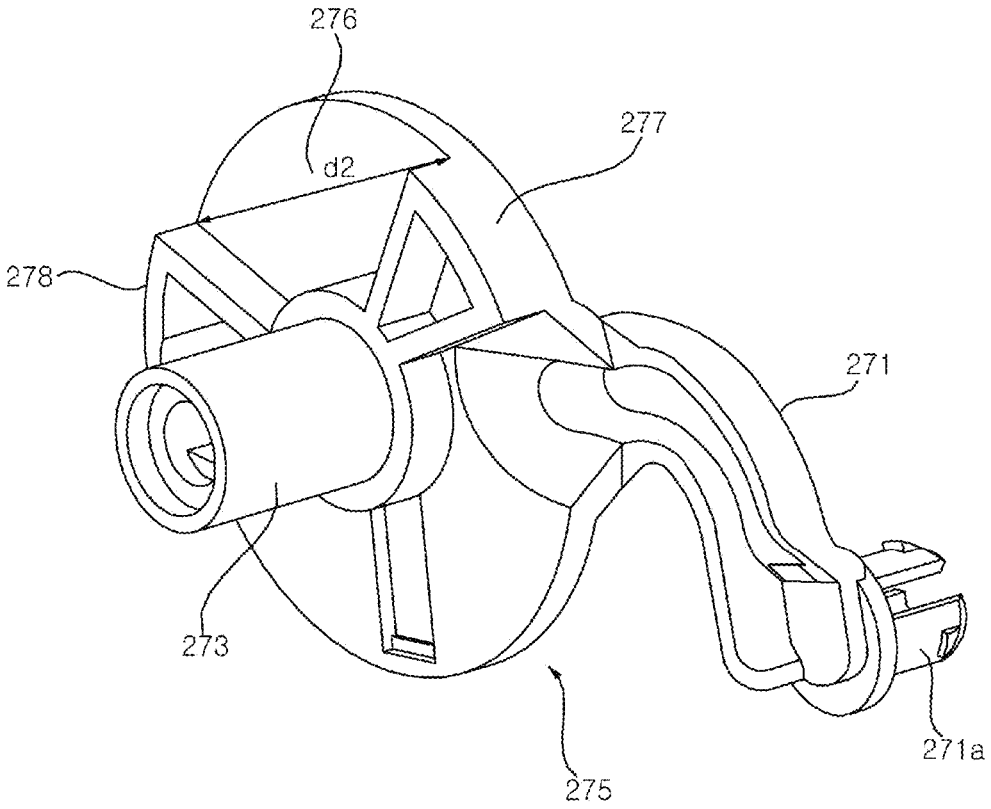
FIG. 24 is a rear perspective view of the drive link of FIG. 23.
Figure 25:
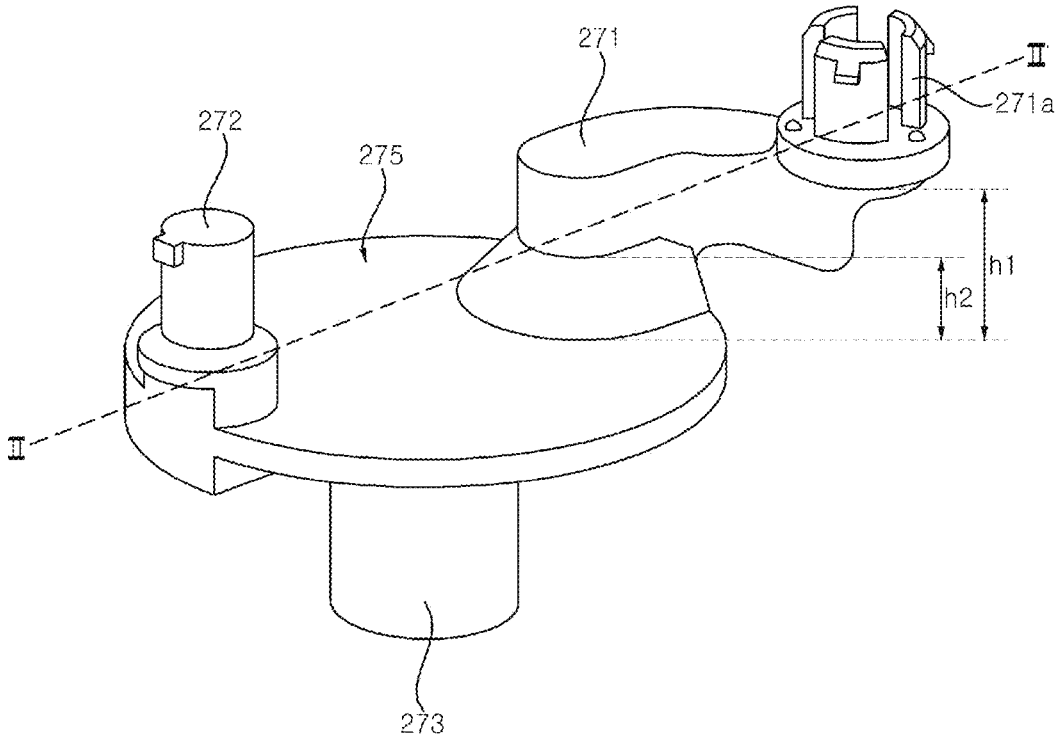
FIG. 25 is a side perspective view of the drive link of FIG. 23.
Figure 26:
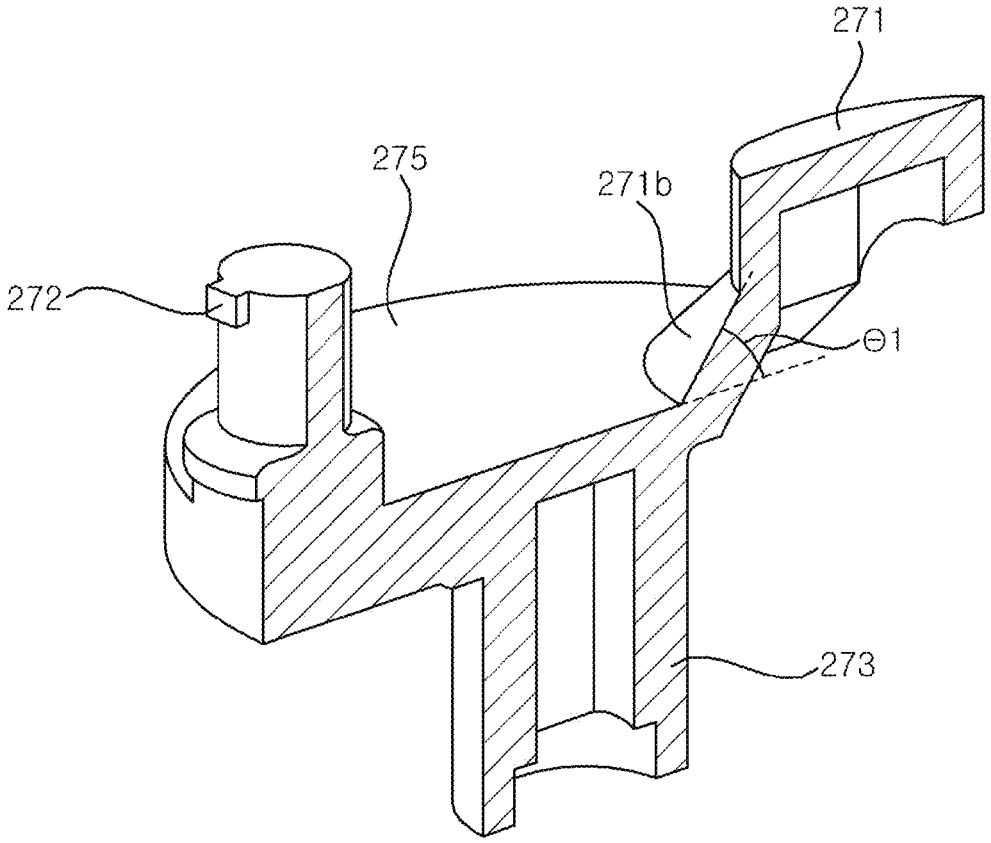
FIG. 26 is a cross-sectional view of the drive link of FIG. 25 as taken along line II-II'.

FIG. 23 is a front perspective view of a drive link of a vane module according to yet another embodiment of the present disclosure, and FIG. 24 is a rear perspective view of the drive link of FIG. 23. FIG. 25 is a side perspective view of the drive link of FIG. 23, and FIG. 26 is a cross-sectional view of the drive link of FIG. 25 as taken along line II-II'.

The vane module according to yet another embodiment of the present disclosure has a configuration similar to that of another embodiment of the present disclosure described above.

Therefore, the description of the motor coupling part 430A, the first vane link 250, the second vane link 260, the first vane 210 and the second vane 220 having the same configuration will be omitted and other parts The in-drive link 270A will be described.

In the motor coupling part 430A, a plurality of openings and guide grooves 405 disposed at a side surface toward the first vane 210 and the second vane 220 out of the side surfaces of the module body unit 440, and allowing the drive link 240, the first vane link 250, and the second vane link 260 to be coupled to respective link installation parts 470 are formed.

A guide groove 405 having a step along a circumference of a circle surrounding the drive link coupling hole 406 based on the drive link coupling hole 406 and provided for insertion of the drive link itself is included.

The guide groove 405 is defined as a disk-shaped groove having a predetermined distance from the drive link coupling hole 406 as a center, as described above. The predetermined distance corresponds to a radius of the drive link 270 to accommodate the drive link 270A.

The guide groove 405 forms a path in which each coupling shaft of the drive link 270A is installed and moved while rotating.

The vane motor 230 is assembled with the outside of the motor coupling part 430A. The rotational shaft of the vane motor 230 is rotatably coupled to a central axis of the drive link 270.

As such, since a coupling body capable of being directly and rotatably coupled to each link and each vane is formed in the shape of holes and grooves in the motor coupling part 430A, which is one surface of the module body 410, a coupling thickness as large as a thickness of the case of the motor coupling part 430A is required and the thickness is not increased by protrusion required for link coupling, and thus, the size of the module is minimized.

Accordingly, the thickness of the drive link 270A protruding toward an air passage is significantly reduced, so the discharged air and the drive link 270A come into contact with each other, thereby preventing a decrease in a flow force of the air and also preventing dew condensation in a corresponding contact area, the dew condensation which may cause damage to equipment damage.

In this case, a stopper 409 for controlling an angle of rotation of the drive link 270A is included in the guide groove 405 of the motor coupling part 430A.

That is, as shown in FIG. 17, a protrusion having a first width d1 is formed in a bottom surface of the guide groove 405. The protrusion as the stopper 409 may prevent rotation by more than a predetermined angle while the drive link 270A connected to the vane motor 230 to reduce variability of a control angle of the vane motor 230 is in contact with the motor coupling part 430A. Accordingly, the angle of rotation of the drive link 270A may be controlled by the stopper 409 to define an angle of opening/closing of the first vane 210 and the second vane 220.

The stopper 409 may be a sector-shaped protrusion protruding along a circular arc along a bottom surface of the circular guide groove 405, and the protruding height of the stopper 409 is set lower than that of a link surface of the motor coupling part 430A so as not to be protrude above the motor coupling part 430A due to a thickness of the drive link 270A covered on the stopper 409.

Accordingly, the protrusion height of the stopper 409 is smaller than a depth of the guide groove 405.

Meanwhile, referring to FIGS. 24 to 26, the drive link 270A is directly connected to the vane motor 230. A rotational shaft (not shown) of the vane motor 230 is directly coupled to the drive link 270A, and an amount of rotation of the drive link 270A is determined by an angle of rotation of the rotational shaft of the vane motor 230.

The drive link 270A is seated in and coupled to the guide groove 405 formed in a front surface of the motor coupling part 430A, is assembled with the second vane link 260 and the first vane 210 at the front surface of the motor coupling part of 430A, and is assembled with the vane motor 230 at a rear surface of the motor coupling part 430A.

The drive link 270A includes: a drive link body 275; a first drive link shaft 271*a* disposed at the drive link body 275 and rotatably coupled to the first vane 210; a core link shaft 273 disposed at the drive link body 275, aligned with the drive link coupling hole 406 of the motor coupling part 430A, and rotatably coupled by the second vane 220; and a second drive link shaft 272 disposed at the drive link body 275 and rotatably coupled to the second vane link 260.

The drive link body 275 has the core link shaft 273 disposed therein, and has a shape corresponding to the shape of the guide groove 405, so that the drive link body 275 is inserted into the guide groove 405 and rotatably coupled thereto.

Referring to FIGS. 24 and 25, the core link shaft 273 protrudes from the drive link body 275 toward the vane motor 230.

The core link shaft 273 is rotatably assembled with the motor coupling part 430A. The core link shaft 273 is aligned with the drive link coupling hole 406 formed in the motor coupling part 430A. The core link shaft 273 may be relatively rotatable while aligned with the drive link coupling hole 406.

In this case, a plurality of protrusions 277 and 278 are formed in the rear surface of the drive link body 275, that is, toward the vane motor 230, and define an angle of rotation in engagement with the stopper 409

In this case, the plurality of protrusion protrusions 277 and 278 includes two protrusion protrusions 277 and 278, and a spacing groove 276 for forming a separation distance between the two protrusion protrusions 277 and 278 is formed.

The protrusions 277 and 278 may be formed to have a sector shape along the circular drive link body 275 so that the stopper 409 of the motor coupling part 430A is engaged therewith, and may have the same size as each other.

In this case, the stopper 409 is engaged with the spacing groove 276 between the protrusions 277 and 278, and the spacing groove 276 also has a sector shape recessed along an arc.

In this case, the spacing groove 276 may have a second width d2, and the second width d2 may have a greater value than that of the first width d1 of the stopper 409.

The range of the angle of rotation of the drive link 270A is defined depending on the ratio of the first width d1 and the second width d2, so that a distribution of the angle of opening and closing of the first vane 210 and the second vane 220 may be defined and optimized.

Meanwhile, the first drive link shaft 271*a* and the second drive link shaft 272 protrude in a direction opposite to the core link shaft 273, that is, toward the front surface where the first vane 210 and the second vane 220 are disposed.

The core link shaft 273 is formed in a cylindrical shape which is empty inside. The motor shaft of the vane motor 230 is inserted into a hollow formed inside the core link shaft 273.

The first drive link shaft 271*a* is a shaft rotation structure for rotation with the first vane 210.

The first drive link shaft 271*a* may be formed at one end of a protruding area 271 that protrudes from a point of the drive link body 275 and extends downward, and the protruding area 271 corresponds to the first drive link shaft installation part 246-1 bent at an extended portion of the first drive link body 246 of FIG. 8 and extending downward.

That is, the first drive link shaft 271*a* is formed at an end portion of the protruding area 271.

The protrusion area 271 is formed to be wider than a diameter of the first drive link shaft 271*a*. The protrusion region 271 may be in close contact with the first vane 210 and may support the first vane 210.

The first drive link shaft 271*a* and the protruding area 271 protrude toward the first vane 210 (in a direction opposite to the core link shaft).

An inclined part 271*b* is formed at a connection portion between the protruding area 271 and the drive link body 275, as shown in FIGS. 25 to 26.

When a height from the drive link body 275 to an upper surface of the protruding area has a first height h1, the inclined part 271*b* may occupy a second height h2 in the first height h1.

In this case, the first height h1 may be between 0.9 cm and 1.2 cm, and preferably may be formed to satisfy a range of about 1.0 cm. In addition, the second height h2 may satisfy a range of 0.2 to 0.7 cm, and may preferably satisfy a range of 0.35 to 0.6 cm.

In addition, the inclined part 271*b* may have an inclination to maintain a first angle θ1 from the drive link body 275.

The inclination θ1 of the inclined part 271*b* may satisfy a range of 40 to 60 degrees, and may preferably satisfy a range of 45 to 55 degrees.

In this way, in a case where the inclined part 271*b* is formed between the protruding area 271 with the first drive link shaft 271*a* formed therein and the drive link body 275, when a plurality of rotation planes are connected, rotation is performed with the inclined part 271 provided, thereby dispersing stress concentration, and thus, damage to an element may be prevented.

Figure 27:
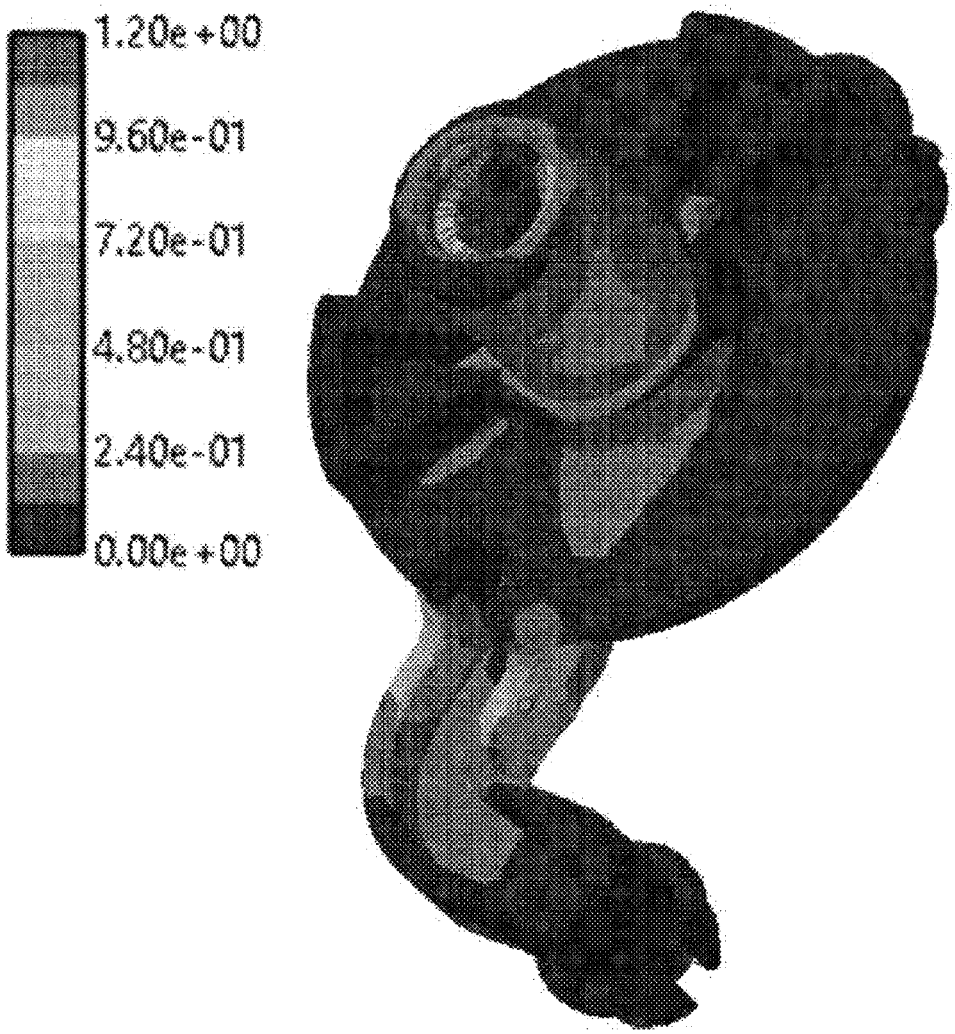
FIG. 27 is a view showing the effect of stress dispersion of the drive link of the vane module according to yet another embodiment of the present disclosure.

FIG. 27 is a view showing the effect of stress dispersion of a drive link of a vane module according to yet another embodiment of the present disclosure.

In the case of bar-shaped link coupling having multiple panel points as in the previous embodiments of the present disclosure, when various rotations are performed, the positions of shaft directions are different from each other at a plurality of panel points, hence stress is concentrated at an end portion of a shaft and there may be a problem of damage to an element.

In order to prevent such element damage, in FIGS. 25 and 26, stress gradient is provided even for the inclined part 271*b*. When stress is measured as shown in FIG. 27, a maximum stress applied to a corresponding panel point is 0.70 Mpa, which shows the tendency of a very decrease compared to a previous module, a factor of safety may be increased by 86%, and element stability may be secured by increasing fatigue life.

Other configurations are the same as those in the previous description, and thus a detailed description thereof will be omitted.

In the four-bar structure of each of these dual vanes, a thickness may be further reduced by forming a guide groove 405 into which the drive link 270A is allowed to be inserted in the motor coupling part 430A corresponding to a case as in FIG. 16, and since a hole for the guide is not exposed, it is possible to prevent a flow loss, vibration, and noise that may occur due to air being discharged to the outside. In addition, since it is possible to control the angle of rotation of the drive link 270A as the stopper 409 is provided in the guide groove 406, it is possible to specify a vane angle, thereby preventing excessive rotation of the vane motor and preventing damage to the vanes and links and deformation thereof. In addition, it is possible to reduce discomfort such as vibration and noise by reducing variability of a closing angle. In addition, as the inclined part 271*b* is provided between the body and the shaft, the stress is dispersed and a lifespan of a component is increased.

The invention claimed is:

1. An indoor unit of an air conditioner, the indoor unit comprising:

a case having an outlet; and a vane module that is disposed at the case and guides a flow direction of air discharged from the outlet, wherein the vane module comprises:

a first vane rotatably installed in the outlet;

a second vane rotatably installed in the outlet;

two motor coupling parts disposed at both ends of the first vane and the second vane, respectively, wherein at least a portion of each of the two motor coupling parts is exposed to the outlet;

a vane motor that is assembled with at least one of the two motor coupling parts and provides a drive force;

a drive link that is assembled to be rotatable with respect to the motor coupling part, rotated by the driving drive force of the vane motor, and transmit the drive force to the first vane and the second vane;

a first vane link assembled to be relatively rotatable with respect to the drive link and the motor coupling part on a forward side of the drive link to thereby rotate the first vane; and a second vane link assembled to be relatively rotatable with respect to the drive link and the motor coupling part on the forward side of the drive link to thereby rotate the second vane, wherein the first vane link and the second vane link are assembled in a line with the drive link on the forward side of the drive link, wherein the motor coupling part comprises two guide holes that indicate a path of rotation of the drive link, the drive link passing through the two guide holes and being assembled with the motor coupling part, wherein the two guide holes are formed in the motor coupling part with a drive link coupling hole as a center, and wherein the two guide holes are each formed in an arc shape along a circumference of a circle at a predetermined distance from the drive link coupling hole as the center.

2. The indoor unit of claim 1, wherein the vane module further comprises a link installation part coupled to the case, and whereinthe motor coupling part is bent at the link installation part and is assembled to be relatively rotatable with respect to the drive link, the first vane link, and the second vane link.

3. The indoor unit of claim 2, wherein the vane motor is installed on an opposite side to the outlet with respect to the motor coupling part.

4. The indoor unit of claim 1, wherein the motor coupling part comprises the drive link coupling hole to which the drive link and the driving motor are coupled, a first vane link coupling hole with which the first vane link is assembled, and a second vane coupling hole with which the second vane is assembled.

5. The indoor unit of claim 1, wherein the first guide hole and the second guide hole are formed to be symmetrical with each other with respect to the drive link coupling hole and spaced apart from each other by a predetermined distance at upper and lower portions.

6. The indoor unit of claim 5, wherein an upper separation distance between the first guide hole and the second guide hole is smaller than a lower separation distance therebetween.

7. The indoor unit of claim 1, wherein the drive link comprises:

a core body;

a core link shaft disposed at the core body, aligned with a core link coupling hole of the motor coupling part, and coupled to the vane motor;

a first drive link shaft that extends from the core body and is rotably coupled to the first vane; and a second drive link shaft that extends from the core body and is rotatably coupled to the second vane link.

8. The indoor unit of claim 7, wherein the core body of the drive link is disposed toward the vane motor in the motor coupling part, and wherein the first drive link shaft and the second drive link shaft pass through the first guide hole and the second guide hole, respectively.

9. The indoor unit of claim 7, wherein the core link shaft of the drive link protrudes in an opposite direction to the first drive link shaft and the second drive link shaft.

10. The indoor unit of claim 1, wherein the first vane comprises:

a first vane body that extends lengthwise in a longitudinal direction of the outlet; and a first joint rib that protrudes upward from the first vane body and is assembled so that the drive link and the first vane link are relatively rotatable, and wherein the first joint rib comprises a first joint part assembled to be relatively rotatable with the first vane link, and a second joint part assembled to be relatively rotatable with the drive link.

11. The indoor unit of claim 10, wherein the second vane comprises:

a second vane body that extends lengthwise in the longitudinal direction of the outlet;

a second joint rib that protrudes upward from the second vane body and is rotatably coupled to the second vane link; and a pair of second vane shafts formed in the second vane body and rotatably coupled to the link installation part.

12. The indoor unit of claim 11, wherein only the first vane link is located between the first joint rib and the motor coupling part, and wherein only the second vane link is located between the second joint rib and the motor coupling part.

13. An indoor unit of an air conditioner, the indoor unit comprising:

a case having an outlet; and a vane module that is disposed at the case and guides a flow direction of air discharged from the outlet, wherein the vane module comprises:

a first vane rotatably installed in the outlet;

a second vane rotatably installed in the outlet;

two motor coupling parts disposed at both ends of the first vane and the second vane, respectively, wherein at least a portion of each of the two motor coupling parts is exposed to the outlet;

a vane motor that is assembled with at least one of the two motor coupling parts and provides a drive force;

a drive link that is assembled to be rotatable with respect to the motor coupling part, rotated by the drive force of the vane motor, and transmit the drive force to the first vane and the second vane;

a first vane link assembled to be relatively rotatable with respect to the drive link and the motor coupling part on a forward side of the drive link to thereby rotate the first vane;

a second vane link assembled to be relatively rotatable with respect to the drive link and the motor coupling part on the forward side of the drive link to thereby rotate the second vane; and a link installation part coupled to the case, wherein the motor coupling part is bent at the link installation part and is assembled to be relatively rotatable with respect to the drive link, the first vane link, and the second vane link, wherein the first vane link and the second vane link are assembled in a line with the drive link on the forward side of the drive link, and wherein the motor coupling part comprises at least one guide groove that indicates a path of rotation of the drive link, and wherein the drive link is inserted into the at least one guide groove to be assembled with the motor coupling part.

14. The indoor unit of claim 13, wherein the motor coupling part comprises a drive link coupling hole formed in the at least one guide groove and coupled to the drive link and the drive motor, a first vane link coupling hole with which the first vane link is assembled toward an outside of the at least one guide groove, and a second vane coupling hole with which the second vane is assembled.

15. The indoor unit of claim 14, wherein the at least one guide groove is formed in a circle shape having a diameter of a predetermined distance from the drive link coupling hole as a center.

16. The indoor unit of claim 15, wherein the drive link comprises:

a disk-shaped core body inserted into the at least one guide groove;

a core link shaft disposed at the core body, aligned with a core link coupling hole of the motor coupling part, and coupled to the vane motor;

a first drive link shaft that extends from the core body and is rotably coupled to the first vane; and a second drive link shaft that extends from the core body and is rotatably coupled to the second vane link.

17. The indoor unit of claim 16, wherein the first drive link shaft and the second drive link shaft of the drive link are formed in directions opposite to each other with respect to the core link shaft.

* * * * *